US008282871B2

(12) United States Patent
Davies et al.

(10) Patent No.: US 8,282,871 B2
(45) **Date of Patent: *Oct. 9, 2012**

(54) TECHNIQUES AND TOOLS FOR ASSEMBLING AND DISASSEMBLING COMPACTABLE MOLDS AND FORMING BUILDING BLOCKS

(75) Inventors: Franklin David Davies, Vancouver (CA); Rudolf Alfred Heijden, Beaverton, OR (US); Richard William Kay, Troutdale, OR (US); George Briggs Middleton, Portland, OR (US); Robert H. Nippert, Sandy, OR (US)

(73) Assignee: Lacuna Inc., Winchester, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/176,658

(22) Filed: Jul. 5, 2011

(65) Prior Publication Data

US 2011/0260364 A1 Oct. 27, 2011

Related U.S. Application Data

(62) Division of application No. 11/648,850, filed on Dec. 29, 2006, now Pat. No. 7,992,837.

(51) Int. Cl.
*B28B 7/02* (2006.01)
*B28B 1/44* (2006.01)

(52) U.S. Cl. ..... 264/334; 264/304; 264/336; 425/436 R; 425/438; 425/441; 425/436 RM; 249/64; 249/122; 249/125; 249/162; 249/177

(58) Field of Classification Search ..... 249/70, 249/76, 120–125, 136, 139, 142, 145–147, 249/151, 155–158, 160–163, 165, 176, 177, 249/180, 63–64; 264/333, 334, 336, 304, 264/297.9, 34, 33; 425/414, 422, 436 R, 425/436 RM, 438, 441, 444, 466–469
See application file for complete search history.

(56) References Cited

U.S. PATENT DOCUMENTS

| | | | |
|---|---|---|---|
| 785,272 | A | 3/1905 | Robbins |
| 799,493 | A | 9/1905 | Pfieffer |
| 826,599 | A | 7/1906 | Normandin |
| 830,620 | A | 9/1906 | Stare |
| 848,091 | A | 3/1907 | Dunmore |
| 1,375,953 | A | 4/1912 | DeCiciliani |
| 1,337,618 | A | 4/1920 | Pipe |

(Continued)

OTHER PUBLICATIONS

Amazon Forms, "Products> Grid-Wall: Description: Our Standard Block," 5 pp.

(Continued)

*Primary Examiner* — Dimple Bodawala
(74) *Attorney, Agent, or Firm* — Klarquist Sparkman, LLP

(57) ABSTRACT

A system includes one or more compacting wall retraction mechanisms for retracting one or more compacting walls of a compactable lightweight concrete block mold having at least two compacting walls. The compacting wall retraction mechanism(s) facilitate release of a compacted lightweight concrete block from the compactable lightweight concrete block mold. The system can include a mold feed conveyor, and a table for receiving the compactable lightweight concrete block mold from the mold feed conveyor. The system can include one or more tube extraction and re-insertion mechanisms for extracting or inserting tubes of a compactable mold. The system can include one or more end wall lock release mechanisms for releasing end walls to remove a molded block from the mold. Mold assembly and disassembly can be controlled by an electronic or computerized controller.

10 Claims, 22 Drawing Sheets

U.S. PATENT DOCUMENTS

| | | | | | |
|---|---|---|---|---|---|
| 1,499,587 | A | | 1/1924 | Meyer | |
| 1,688,627 | A | | 10/1928 | Long | |
| 1,701,438 | A | | 2/1929 | Baum et al. | |
| 1,706,647 | A | | 3/1929 | Besser | |
| 1,905,897 | A | * | 4/1933 | Cahill | 249/64 |
| 1,977,374 | A | | 10/1934 | Brooke et al. | |
| 2,206,803 | A | * | 7/1940 | Brimhall | 249/123 |
| 2,276,558 | A | | 3/1942 | Zuber | |
| 2,366,401 | A | | 1/1945 | Haskell | |
| 2,522,116 | A | | 9/1950 | Hayes | |
| 2,545,002 | A | | 3/1951 | Miller | |
| 2,550,977 | A | * | 5/1951 | Dimock | 249/93 |
| 2,560,722 | A | | 7/1951 | Godefroid et al. | |
| 2,611,434 | A | | 9/1952 | Mugler | |
| 2,663,063 | A | * | 12/1953 | Van Loon | 264/297.9 |
| 2,856,668 | A | | 10/1958 | Cravens | |
| 2,875,499 | A | | 3/1959 | Ross | |
| 2,934,807 | A | | 5/1960 | Donati | |
| 3,030,687 | A | * | 4/1962 | Muspratt | 264/71 |
| 3,218,774 | A | | 11/1965 | McNiel | |
| 3,247,294 | A | | 4/1966 | Sabouni | |
| 3,279,021 | A | | 10/1966 | Pratt et al. | |
| 3,281,510 | A | * | 10/1966 | Lovret | 264/46.2 |
| 3,384,335 | A | * | 5/1968 | Schwarz | 249/67 |
| 3,442,991 | A | | 5/1969 | Lanz | |
| 3,587,143 | A | * | 6/1971 | Sonneville | 425/100 |
| 3,608,162 | A | * | 9/1971 | Staton | 425/457 |
| 3,642,400 | A | | 2/1972 | Theodorsen | |
| 3,661,604 | A | | 5/1972 | Artmann | |
| 3,764,357 | A | | 10/1973 | Bowles et al. | |
| 3,797,986 | A | | 3/1974 | Onder | |
| 3,809,516 | A | | 5/1974 | Komaki | |
| 4,306,395 | A | | 12/1981 | Carpenter | |
| 4,332,540 | A | | 6/1982 | Van de Caveye | |
| 4,351,867 | A | | 9/1982 | Mulvey et al. | |
| 4,395,220 | A | | 7/1983 | Harter | |
| 4,439,131 | A | | 3/1984 | Nagy et al. | |
| 4,445,839 | A | | 5/1984 | Crane | |
| 4,552,716 | A | | 11/1985 | Habich | |
| 4,563,144 | A | | 1/1986 | Rose | |
| 4,613,472 | A | | 9/1986 | Svanholm | |
| 4,666,389 | A | | 5/1987 | Relis et al. | |
| 4,670,204 | A | | 6/1987 | Cruise | |
| 4,702,877 | A | | 10/1987 | Davis, Jr. | |
| 4,725,214 | A | * | 2/1988 | Piazza et al. | 425/149 |
| 4,802,836 | A | | 2/1989 | Whissell | |
| 4,831,801 | A | | 5/1989 | Stracke | |
| 4,836,762 | A | | 6/1989 | Davis, Jr. | |
| 4,902,211 | A | | 2/1990 | Svanholm | |
| 4,944,907 | A | | 7/1990 | Davis, Jr. | |
| 5,002,711 | A | | 3/1991 | Iwama et al. | |
| 5,108,282 | A | | 4/1992 | Pardo | |
| 5,183,616 | A | * | 2/1993 | Hedrick | 264/219 |
| 5,248,466 | A | | 9/1993 | Russell, III | |
| 5,397,228 | A | | 3/1995 | Metten | |
| 5,522,658 | A | * | 6/1996 | John | 366/15 |
| 5,589,124 | A | | 12/1996 | Woolford et al. | |
| 5,622,556 | A | | 4/1997 | Shulman | |
| 5,639,297 | A | | 6/1997 | Stracke et al. | |
| 5,667,192 | A | | 9/1997 | Van Doren | |
| 5,728,312 | A | | 3/1998 | Van Doren | |
| 5,737,896 | A | | 4/1998 | Rodgers | |
| 5,913,791 | A | | 6/1999 | Baldwin | |
| 5,974,762 | A | | 11/1999 | Rodgers | |
| 6,085,480 | A | | 7/2000 | Baldwin | |
| 6,106,264 | A | | 8/2000 | Stenekes | |
| 6,290,769 | B1 | | 9/2001 | Carkner | |
| 6,397,549 | B1 | | 6/2002 | Baldwin | |
| 6,499,985 | B1 | | 12/2002 | Sekiguchi et al. | |
| 6,555,040 | B1 | | 4/2003 | Lienau | |
| 6,588,168 | B2 | | 7/2003 | Walters | |
| 6,676,862 | B2 | | 1/2004 | Jensen | |
| 6,746,532 | B2 | | 6/2004 | Boronkay | |
| 6,758,020 | B2 | | 7/2004 | Cerrato | |
| 6,793,476 | B2 | * | 9/2004 | Bryja et al. | 425/145 |
| 6,827,570 | B2 | | 12/2004 | Sumrall et al. | |
| 6,851,235 | B2 | | 2/2005 | Baldwin | |
| 6,878,315 | B2 | | 4/2005 | Jarvinen et al. | |
| 6,974,317 | B2 | | 12/2005 | Sumrall | |
| 7,470,121 | B2 | | 12/2008 | Ness et al. | |
| 7,487,949 | B2 | | 2/2009 | Bennett | |
| 7,862,763 | B2 | * | 1/2011 | Tufts et al. | 264/333 |
| 7,942,658 | B1 | * | 5/2011 | Jensen | 425/4 R |
| 7,988,123 | B2 | * | 8/2011 | Davies et al. | 249/162 |
| 7,992,837 | B2 | * | 8/2011 | Davies et al. | 249/162 |
| 2004/0045237 | A1 | | 3/2004 | Coombs et al. | |
| 2005/0072112 | A1 | | 4/2005 | Sumrall | |
| 2005/0121595 | A1 | | 6/2005 | Ness et al. | |
| 2005/0257457 | A1 | | 11/2005 | Sumrall | |
| 2005/0257458 | A1 | | 11/2005 | Sumrall | |
| 2005/0260296 | A1 | | 11/2005 | Sumrall | |
| 2005/0262793 | A1 | | 12/2005 | Sumrall | |
| 2005/0284098 | A1 | | 12/2005 | Sumrall | |
| 2006/0000172 | A1 | | 1/2006 | Sumrall | |
| 2007/0138703 | A1 | | 6/2007 | Ojanen | |
| 2008/0156963 | A1 | | 7/2008 | Davies et al. | |
| 2008/0157430 | A1 | | 7/2008 | Davies et al. | |
| 2008/0160126 | A1 | | 7/2008 | Davies et al. | |
| 2009/0232922 | A1 | | 9/2009 | Schlipf et al. | |

OTHER PUBLICATIONS

Build It Green, "Resource Guide for Landscaping and Green Building: Structural," 10 pp. (Document dated Sep. 25, 2006) [Downloaded from the World Wide Web on Nov. 28, 2003].

California EPA, Integrated Waste Management Board, "Designing with Vision: A Technical Manual for Material Choices in Sustainable Construction," pp. i, 50-54 (Jul. 2000).

Cempo Forms, Inc., "Forms Installation Guide: Section 1," 10 pp. [Downloaded from the World Wide Web on Apr. 2, 2007].

Cempo Forms, Inc., "The Building System of the Future, and the Future is Today," 2 pp.

Green Depot Inc., "Rastra Specifications and Data Sheet," 1 p. (Document dated 2002).

Harrington, "Guild Members Use Rastra," *EcoBuilding Times*, 2 pp. (Document dated 1999-2002) [Downloaded from the World Wide Web on Nov. 28, 2003].

ICBO Evaluation Service, Inc., "ES Report™: Perform Wall Panel System," ER-5949 (Document dated Jul. 1, 2001).

ICBO Evaluation Service, Inc., "ES Legacy Report: Perform Wall Panel System," ER-5949 (Document dated Jul. 1, 2003).

ICBO Evaluation Service, Inc., "ES Legacy Report: Rastra Wall Panel System," 9955B (Document dated Nov. 1, 2004).

International Search Report and Written Opinion for PCT/US07/88205, dated Jun. 9, 2008, 11 pages.

International Search Report and Written Opinion for PCT/US07/88208, dated Jun. 9, 2008, 11 pages.

International Search Report and Written Opinion for PCT/US07/88209, dated May 1, 2008, 11 pages.

Perform Wall, LLC, "Perform Wall Panel System: Copyright and Trademark Protection Notice," 1 p. (Document dated 2001) [Downloaded from the World Wide Web on Nov. 28, 2003].

Perform Wall, LLC, "Perform Wall Panel System: The Product," 1 p. [Downloaded from the World Wide Web on Nov. 28, 2003].

Perform Wall, LLC, "Perform Wall Panel System: The Product—Specifications," 1 p. [Downloaded from the World Wide Web on Nov. 28, 2003].

Permanent Buildings & Foundations, "Permanent Buildings & Foundations ICF Comparison Chart," 2 pp.

Rastra of the Americas, L.L.C., "RASTRA—The Environmentally Friendly Solution: Installation Guide," 2 pp. (Document dated 1999, 2003) [Downloaded from the World Wide Web on Nov. 28, 2003].

Rastra Found., "RASTRA—A Sensible Approach," pp. vii-xvii, 1-1, 1-2, 1-3, 1-4, 1-5, 1-6, 1-7, 1-8, 1-9, 1-10 (Document dated Apr. 2002).

Rastra Found., "What is RASTRA®," 4 pp. (Document dated 1999, 2003) [Downloaded from the World Wide Web on Nov. 28, 2003].

SASC Inc., "Insulated Concrete Forms—Rastra," Section 03135, 5 pp. (Document dated May 20, 2002).

Schierhorn, "Producing Structural Lightweight Concrete Block," reprinted from *Concrete Journal*, 5 pp.

Tech Block International, "Tech Block® FAQs," 3 pp. [Downloaded from the World Wide Web on Sep. 28, 2006].

Timmons, "Alternative Building System Saves Energy," *Environmental Design + Construction*, (Document dated Feb. 22, 2001) [Downloaded from the World Wide Web on Nov. 28, 2003].
Trilogy Materials Ltd., "Perform Wall Panel System: Construction Manual," pp. 1-1, 13-3, 13-4, 13-5 (2002).
Trilogy Materials Ltd., "Perform Wall Panel System: Engineering Quick Reference Guide," Section 1, Table of Contents, and Section 2, 12 pp. (2002).

* cited by examiner

TECHNIQUES AND TOOLS FOR ASSEMBLING AND DISASSEMBLING COMPACTABLE MOLDS AND FORMING BUILDING BLOCKS

CROSS REFERENCE TO RELATED APPLICATIONS

This application is a divisional of U.S. patent application Ser. No. 11/648,850, filed Dec. 29, 2006 now U.S. Pat. No. 7,992,837, the disclosure of which is hereby incorporated herein by reference.

CROSS REFERENCE TO RELATED APPLICATIONS

The following co-pending patent applications relate to the present application and are hereby incorporated herein by reference: U.S. patent application Ser. No. 11/648,716, entitled "COMPACTABLE MOLD FOR FORMING BUILDING BLOCKS," filed Dec. 29, 2006; and U.S. patent application Ser. No. 11/648,102, entitled "COMPACTING TECHNIQUES FOR FORMING LIGHTWEIGHT CONCRETE BUILDING BLOCKS," filed Dec. 29, 2006.

FIELD

This application relates to techniques and tools for forming building blocks, and more particularly relates to techniques and tools for assembling and disassembling molds for forming building blocks.

BACKGROUND

Over the last two decades, innovations in cement-based construction materials have led to improved durability, portability, modularity, and overall quality. For example, building blocks and panels made of a mixture of polystyrene foam, cement, and various chemical admixtures have come into wide use. These lightweight building blocks can be stacked or otherwise arranged during construction in the same general manner as ordinary cement blocks to form walls and other construction elements. These lightweight building blocks and panels can be shaped (e.g., by molding, cutting or drilling) and may include openings or channels to allow placement of reinforcing steel bars, concrete slurry, or other materials to increase the structural integrity and strength of completed construction elements.

Because these building blocks and panels contain a significant proportion of polystyrene foam, they are lighter and easier to handle during construction than pure cement blocks of similar size. Likewise, because of their composition, such blocks and panels are easy to cut, if desired, for installation of electrical wiring or plumbing or for other purposes. Such lightweight concrete blocks and panels have the additional advantage of being highly insulating when compared with traditional building materials. The R-value (a measure of thermal resistance used to characterize insulation) of such blocks and panels is much higher than that exhibited by buildings constructed of wood, brick, or other traditional building materials. Such blocks and panels are also highly fire and insect resistant, dramatically reducing the risk of fire or insect damage to structures made with them.

In a typical process for forming such blocks and panels, varying amounts of polystyrene foam and cement are mixed with liquid chemical admixtures to hold the foam granules together in a light-weight concrete mixture. The light-weight concrete mixture is poured into a mold and cured in the mold until it has hardened enough to be handled by people or machinery. The cured material is removed from the mold and cut to form smaller blocks or panels of desired sizes and shapes.

This typical process of curing a block in a mold has potential problems. The foam granules reduce the fluidity of the mixture and can create anomalies in the density (e.g., when constituent materials settle during curing) and shape (e.g., when the poured mixture does not fully occupy all the space within the mold) of the cured product. Thus, the density and dimensions of the cured, uncut block may be unpredictable. Cutting and re-shaping blocks after curing has several disadvantages, including the cost of wasted scrap material, the cost of personnel to make the required modifications to the block, and the time added to the manufacturing process to accommodate cutting or re-shaping steps.

Moreover, blocks that are cut after curing have an outer surface of open polystyrene granules. These open surfaces can easily absorb water. Thus, when individual building units are cut from larger pre-formed blocks, the individual building units typically must be coated with a water repellant material to prevent water absorption during or after construction.

Furthermore, the large molds used to create building blocks with the desired size, shape, and attributes for finished blocks and panels are heavy and difficult for equipment or workers to handle during the block manufacturing process.

SUMMARY

Techniques and tools for assembling and disassembling compactable molds and forming building blocks are described.

In one aspect, a system includes one or more compacting wall retraction mechanisms for retracting one or more compacting walls of a compactable lightweight concrete block mold having at least two compacting walls. The compacting wall retraction mechanism(s) facilitate release of a compacted lightweight concrete block from the compactable lightweight concrete block mold. The system can include a mold feed conveyor, and a table for receiving the compactable lightweight concrete block mold from the mold feed conveyor. The table can be a scissor lift table operable to raise the compactable lightweight concrete block mold from a lower mold loading area to an upper block release area, lower a reassembled compactable mold from an upper mold reassembly area to a lower mold discharge area, lower a molded block released from a disassembled compactable mold from an upper block removal area to a lower block discharge area, and/or raise a mold base from a lower mold base loading area to an upper mold assembly area. The system can include proximity sensors for determining correct placement of a mold base. The system can include one or more tube extraction and re-insertion mechanisms for extracting or inserting tubes of a compactable mold. The system can include one or more end wall lock release mechanisms for releasing end walls to remove a molded block from the mold. Mold assembly and disassembly can be controlled by an electronic or computerized controller.

In another aspect, a system includes a compactable mold defining a mold cavity for forming a compacted concrete building block, and a mold wall disassembly and reassembly mechanism.

The compactable mold comprises multiple compacting walls and at least one tube attached to at least one of the multiple compacting walls. The mold wall disassembly and reassembly mechanism is operable to move the multiple compacting walls of the compactable mold from a compacted wall position to a retracted wall position during mold disassembly, move the multiple compacting walls from the compacted wall position to the retracted wall position during mold reassembly, move the at least one tube of the compactable mold from an inserted tube position to a retracted tube position during mold disassembly, and move the at least one tube of the compactable mold from the retracted tube position to the inserted tube position during mold reassembly. The mold wall disassembly and reassembly mechanism allows the compacted concrete building block to be removed from the compactable mold in one piece. The compacted concrete building block can have formed therein at least one cavity extending therethrough.

In another aspect, a system comprises plural mold wall disassembly and reassembly mechanisms and a conveyor system for conveying compactable molds to and from the plural mold wall disassembly and reassembly mechanisms. Each compactable mold defines at least one mold cavity for forming compacted concrete building blocks. Each compactable mold comprises multiple compacting walls and at least one tube attached to at least one of the multiple compacting walls. The plural mold wall disassembly and reassembly mechanisms are operable to move multiple compacting walls of a compactable mold from a compacted wall position to a retracted wall position during mold disassembly, move the multiple compacting walls from the compacted wall position to the retracted wall position during mold reassembly, move at least one tube of the compactable mold from an inserted tube position to a retracted tube position during mold disassembly, and move the at least one tube of the compactable mold from the retracted tube position to the inserted tube position during mold reassembly. A conveyor system can be used to convey compacted concrete building blocks from the plural mold wall disassembly and reassembly mechanisms after mold disassembly.

The foregoing and other objects, features, and advantages will become more apparent from the following detailed description, which proceeds with reference to the accompanying figures.

DETAILED DESCRIPTION

Figure 1:
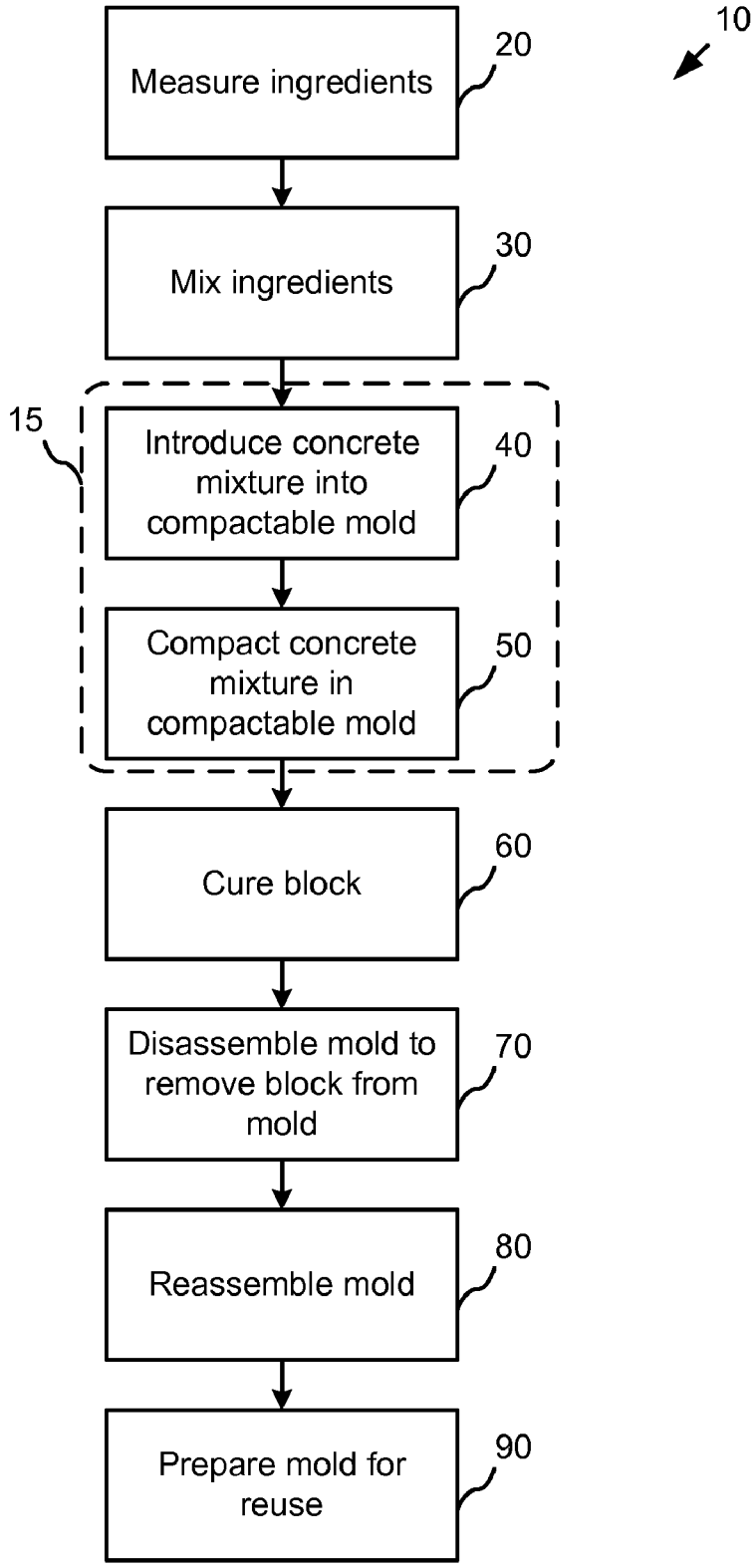
FIG. 1 is a flow chart showing an example technique for manufacturing a compacted lightweight concrete building block according to one implementation.

Described techniques and tools relate generally to forming lightweight concrete construction blocks or panels from lightweight concrete mixtures. The lightweight concrete mixtures described herein include, for example, a light-weight concrete mixture comprising polystyrene foam granules, cement, and one or more liquid chemical admixtures. Alternatively, mixtures of different composition are used. For example, different kinds of foam or other low-density materials can be used in place of polystyrene foam.

Techniques and tools are described for compacting material (e.g., lightweight concrete mixtures) to form blocks or panels such that characteristics of the finished blocks or panels (e.g., size, shape, and density) can be controlled. Described forming and compacting techniques are simple and cost-effective, and can be controlled electronically or by human workers. Described forming and compacting techniques reduce or eliminate the need for revisions (e.g., cutting or shaping) of the blocks after curing. Described tools include a compacting apparatus, a mold with compacting walls, retractable and removable tubes and locking features, and an apparatus for assembling/disassembling a mold.

For example, a lightweight concrete mixture is poured into and held in a mold with compacting walls. The mold walls are constructed of steel, titanium, aluminum, or some other material suitable for compacting the lightweight concrete mixture to a desired size and density. The thickness and other dimensions of the mold walls may vary depending on materials used, the level of desired compression, and other factors. The mold allows the mixture to be compacted within the mold to a consistent density and allows the mixture to fully occupy the compacted mold cavity. The mold can include features such as retractable tubes and removable tubes for forming cavities in a molded block while the mixture is under compression. Such tubes allow fully formed blocks to be released from the mold without destroying the mold or cutting the formed block. The mold can also include one or more features for maintaining compression when a desired block size and density have been achieved, such that no outside pressure (such as from a hydraulic compactor) needs to be exerted on the mold to maintain compression. Such features include locking elements (e.g., flanges that engage with slots or grooves in the compacting wall structures) in the mold that lock compacting walls in place when the walls are moved to a particular position. For example, the compacting walls can lock in place at a position that results in a desired compression level for a particular amount of compressed material. The mold also can include one or more features that allow for clean release of a block from the mold after compaction and initial curing, automated release of a block from the mold, automated disassembly of the mold, and/or automated re-assembly of the mold.

The mold is compacted using a compactor (e.g., a hydraulic compactor, electromechanical compactor, mechanical compactor, or some other kind of compactor). In one implementation, the compactor is separate from the mold. Alternatively, a compactor can be integrated into a mold. The compactor works in cooperating engagement with compacting mold walls to compact the material within the mold. Preferably, the mold walls are arranged in close proximity to one another such that no appreciable amount of the mixture extrudes from the mold during compaction. In one embodiment, the compactor presses evenly and simultaneously on two compacting walls of the mold and stops automatically when the two compacting walls have reached a desired position. In this way, materials within the mold can be compressed at desired compression levels. The particular levels and directions of compression force exerted on the mold and the number and arrangement of sides pressed on a mold can be varied depending on the desired implementation.

Techniques and tools for disassembling a mold (e.g., to release a block from the mold) and for subsequently reassembling the mold (e.g., to prepare it for re-use) also are described. For example, a mold assembly/disassembly unit is controlled by a programmable controller to assemble or disassemble a mold (e.g., a compactable mold for forming lightweight concrete blocks). The mold assembly/disassembly unit can operate in automatic or manual mode to disassemble and/or reassemble a mold during a construction block manufacturing process. The mold assembly/disassembly unit speeds the manufacturing process and can eliminate the need for workers to handle heavy molds during assembly of molds, disassembly of molds, removal of building blocks from molds, and/or reassembly of molds for re-use. Automatic operation can be suspended at any point during mold assembly or disassembly and completed by hand or by operating the mold assembly/disassembly unit in individual steps through the controller.

The techniques and tools described herein can be used to form building blocks or panels of various desired sizes, shapes and densities. Building blocks or panels manufactured in accordance with some of the described techniques and tools can achieve finished tolerances of +/−0.605 inch in thickness, but other tolerances can be achieved depending on implementation. Described techniques can be performed automatically (e.g., by a pre-programmed computerized controller), by human operators, or with a combination of automation and human operation.

Various alternatives to the implementations described herein are possible. For example, techniques described with reference to flow chart diagrams can be altered by changing the ordering of stages shown in the flow charts, by repeating or omitting certain stages, etc.

The various techniques and tools can be used in combination or independently. Different embodiments implement one or more of the described techniques and tools. Some techniques and tools described herein can be used in a building block manufacturing system, or in some other system not specifically limited to building block manufacturing.

I. Block Compacting Techniques and Tools

Techniques for forming building blocks by compacting material (e.g., a light-weight concrete mixture of polystyrene foam, cement, and liquid admixtures) within a compactable mold (e.g., a compactable steel mold) are described. In one implementation, the mold has two compacting side walls, heavy-duty locking flanges, and slots in shafts connected to the compacting side walls into which the locking flanges fit. In one implementation, two flat compression plates integrated into a hydraulic compactor press the compacting side walls toward the center of the compactable mold.

Referring to FIG. 1, a block diagram illustrating a detailed technique 10 for manufacturing compacted building blocks is shown. A more basic technique for compacting materials to form building blocks, independent of other manufacturing steps, is indicated at 15.

As shown in FIG. 1 at 20, ingredients for forming a batch of a lightweight concrete mixture are measured (e.g., by people or by an automated system). In one implementation, the ingredients include dry cement, polystyrene foam granules, and liquid chemical admixtures, wherein the polystyrene comprises approximately 80% of the mixture by volume. Alternatively, the ingredients are pre-measured (e.g., the ingredients may be purchased in specific desired quantities such that additional measuring is not required). At 30, the ingredients for forming the concrete mixture are mixed (e.g., by people or by an automated system). For example, liquid chemical admixtures are mixed with polystyrene granules, and then dry cement is added to the mixture, initiating a desired chemical reaction that allows a molded block to hold together. At 40, the mixture is introduced into a compactable mold. For example, the mixture can be poured by hand or by machine into the mold. Alternatively, mixing of ingredients can be performed in the mold itself, after introducing individual ingredients into the mold, although the mixing of ingredients in the mold itself may be inhibited by the structure of the mold. In one implementation, the initial volume of the un-compacted light-weight concrete mixture is approximately 5.3 to 5.4 cubic feet per block. However, this volume may vary depending on the size and shape of the desired block, the exact ingredients used, or other factors.

At 50, the mixture is compacted to a desired extent using the compactable mold. The specific shape, density and size of the resulting molded block depends on one or more factors, such as the amount and/or composition of the mixture in the mold, the shape and/or configuration of mold walls or tubes, and the amount of compression of the mixture (e.g., compression from external forces such as a hydraulic compactor and/or compression maintained by a locking mechanism on compacting walls of the mold).

In one implementation, the molded block is partially cured (e.g., after approximately ½ hour of curing time) in the mold after compaction at 60, and the mold is disassembled at 70 after partial curing to allow the block to be removed from the mold, and the molded block is allowed to cure more completely outside the mold. For example, in one implementation approximately 48 hours of curing is needed to cure the block completely. However, the amount of time needed for curing will vary depending on humidity, temperature, exact ingredients used, or other factors. Furthermore, curing time can be reduced by using a curing oven, using curing accelerators in the mixture, etc. Alternatively, a molded block could be removed from a mold without disassembling the mold. As another alternative, a molded block cures completely before removal of the block from the mold. As another alternative, if the structural integrity of an uncured block allows, the uncured block can be removed immediately after compaction. If more blocks are to be manufactured, the mold is reassembled at 80 and cleaned (if necessary) and prepared for re-use at 90. Alternatively, the disassembled parts can be cleaned prior to reassembly.

Figure 2:
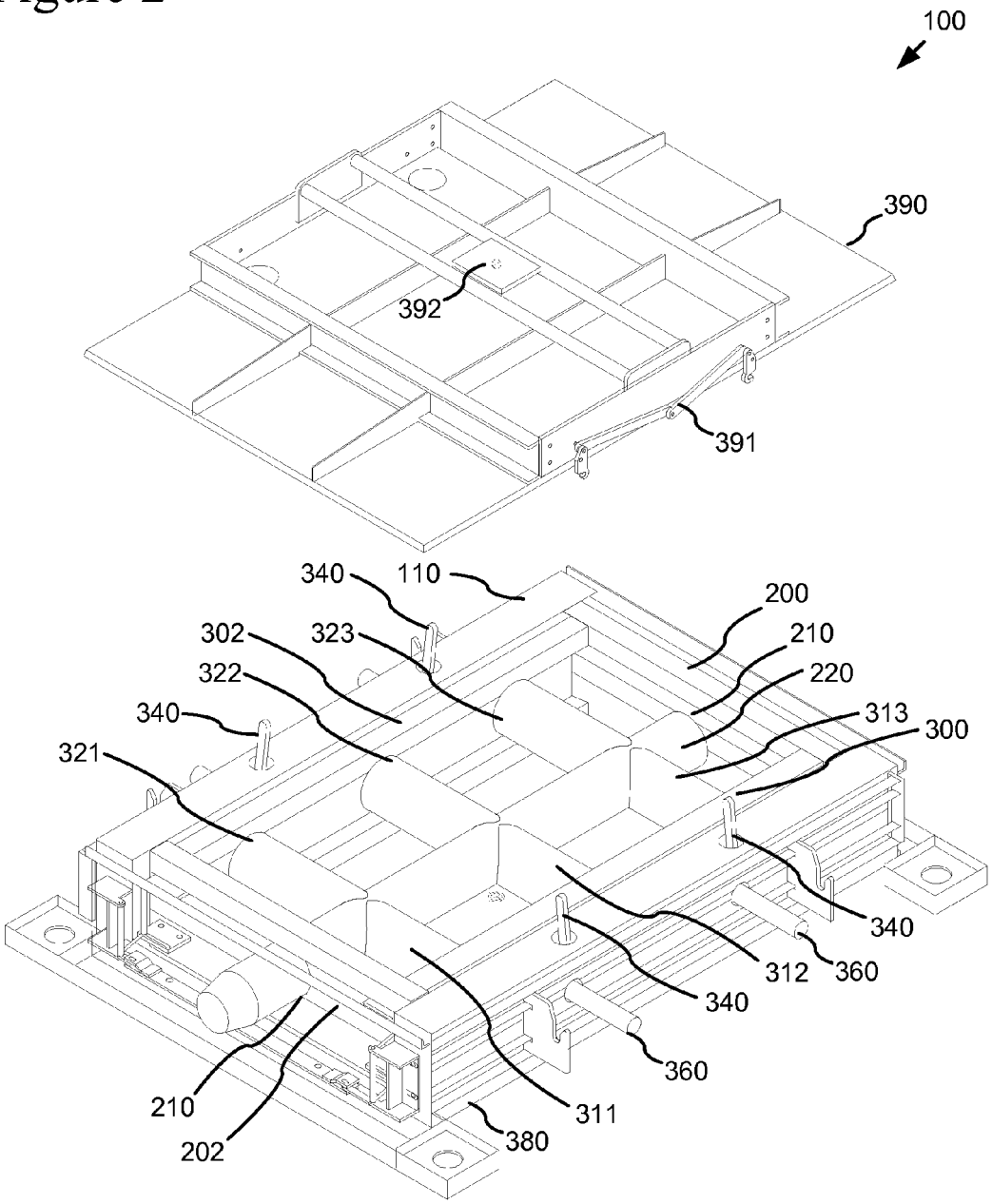
FIG. 2 is a top perspective view of an assembled mold having shafts built into side walls and a detached top lid according to one implementation.

FIG. 2 is a top perspective view of a compactable mold 100 that can be used to form building blocks. In the example shown in FIG. 2, the mold 100 has two compacting walls 300, 302 held within a frame 110 and two shafts 360 integrated into each of the two compacting walls 300, 302. "Compacting wall" refers to a mold wall that can be moved to reduce the volume of the mold cavity and thereby compact a mixture inside the compactable mold. "Compacting wall structure" refers to either a movable wall alone or a compacting wall with one or more shafts, tubes or other features attached or integrated into the compacting wall. In the example shown in FIG. 2, compacting wall 302 forms a tongue or ridge on a formed block, and compacting wall 300 forms a shallow groove on a formed block.

Referring again to FIG. 2, the shafts 360 can be used by a compactor to apply pressure to compacting walls, but such shafts are not required. In one implementation, the shafts are cylindrical and made of solid steel. Alternatively, other shapes or materials can be used or the shafts may be partially or completely hollow to reduce shaft weight.

In the example mold 100 shown in FIG. 2, two end walls 200, 202 each have a hole 210 that enables insertion and removal of a cylindrical tube 220 with a tapered end that extends the length of the block (sometimes referred to herein as a "center tube"). End wall 200 forms a tongue or ridge on a formed block, and end wall 202 forms a shallow groove on a formed block. Tubes 311, 312, 313, 321, 322, 323 (sometimes referred to herein as "side tubes") are designed to fit closely with center tube 220 when the mold is being filled and during compaction. Compacting of material in the mold does not require a center tube or side tubes, and compacting can be performed with other numbers or arrangements of tubes or other mold features. The example mold 100 also includes a detachable mold bottom 380, a removable mold lid 390, mold lid locks 391, and a magnet plate 392 built into the lid 390 to allow the removable mold lid 390 to be lifted from the mold 100. Compacting of a mixture in the mold does not require a detachable mold bottom or removable mold lid 390, and other removable or non-removable lids and bottoms can be used. A mold design that allows removal of a molded block from the mold after compaction should be used.

Figure 4A:
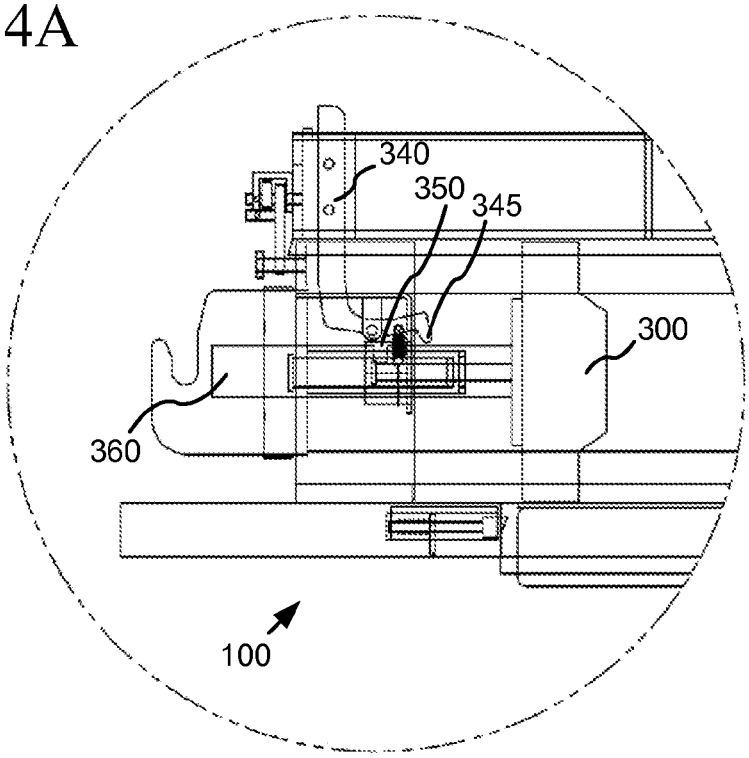
FIGS. 4A and 4B are side elevation views of a locking flange of a mold in an unlocked position and a locked position, respectively, according to one implementation.
Figure 4B:
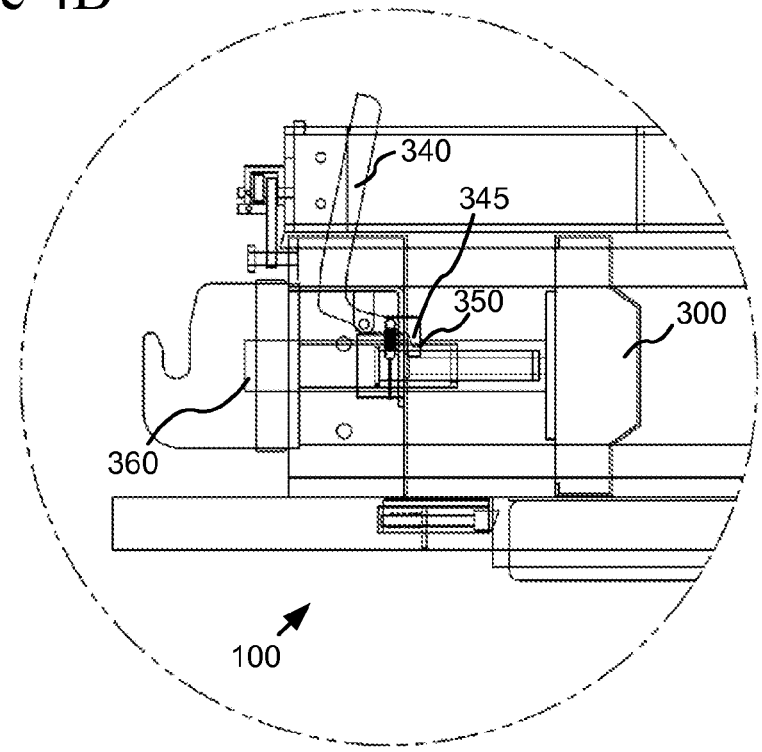

As further illustrated in FIG. 2, the mold 100 includes four heavy-duty flanges 340 (also referred to as "dogs"). When the compacting side walls 300, 302 are moved (e.g., by a compactor exerting force on the compacting side walls) toward the center of the mold to a sufficient extent, the flanges 340 engage with slots in the shafts 360 to lock the compacting side walls in place, as shown in FIGS. 4A and 4B and described in detail below.

Figure 3A:
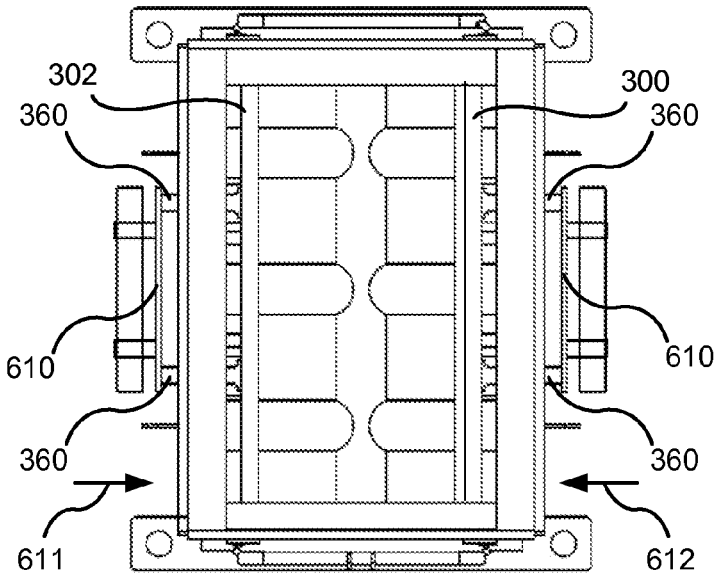
FIGS. 3A and 3B are top plan and front elevation views, respectively, of a compactor with two compression arms and flat compression plates in contact with shafts on compacting walls of a mold prior to compaction on opposite sides of a compression field according to one implementation.
Figure 3B:
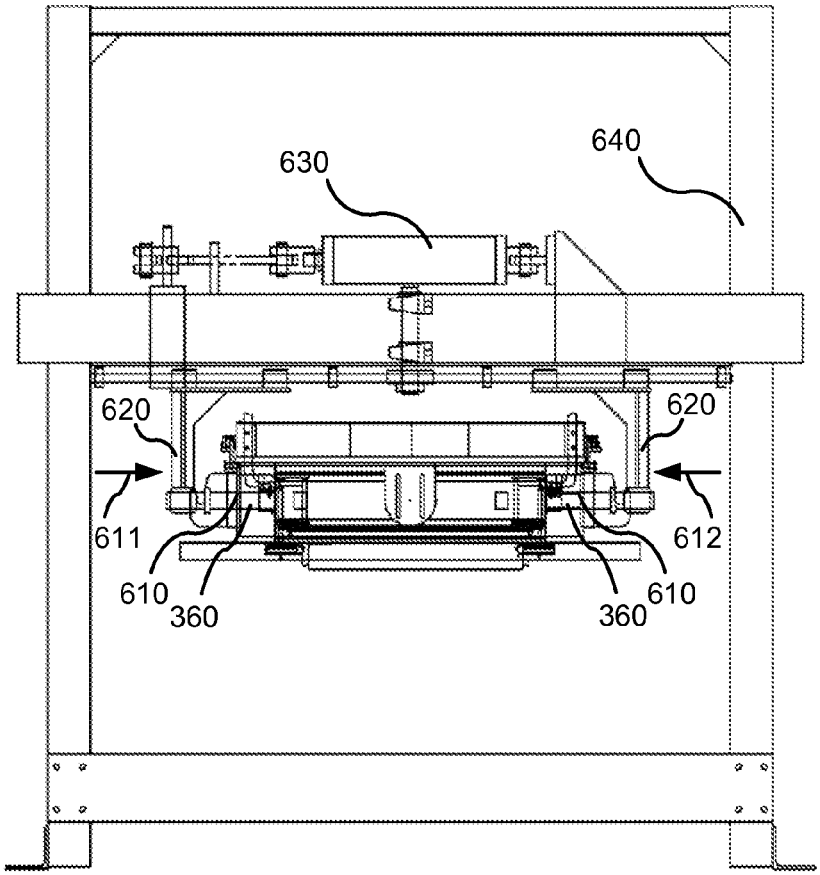

FIG. 3A is a top plan view showing pressure plates 610 pressed against shafts 360 of compacting walls 300, 302 of a compactable mold. FIG. 3B is a front elevation view of a hydraulic compactor compacting the compactable mold shown in FIG. 3A. The shafts 360 extend from the compacting walls 300, 302, outward from the mold cavity. In the example shown in FIGS. 3A and 3B, a hydraulic compactor exerts pressure on the distal ends of the shafts 360 using the pressure plates 610 in order to compact material in the mold. The hydraulic compactor moves the two pressure plates 610 toward one another in the directions shown by arrows 611 and 612, applying pressure against the shafts 360 on the compacting walls 300, 302 of the mold in order to compact the material within the mold. Alternatively, the compactor applies pressure to one or more compacting walls in some other way to compact material in the mold. For example, a compactor can apply pressure directly to a compacting wall without contacting any shafts extending from the compacting wall, without using pressure plates, or using different pressure plate or shaft designs.

Referring now to FIG. 3B, the hydraulic compactor includes a frame 640, a hydraulic pressure generator 630, and two arms 620 that exert force on the two flat pressure plates 610 attached to the arms 620 on opposite sides of the mold. Alternatively, a different kind of compactor (e.g., an electromechanical compactor or a compactor powered by a combustion engine) can be used.

In one implementation, two compacting walls 300, 302 (FIG. 3A) are moved toward one another substantially simultaneously and evenly during compaction. Moving two walls of a compactable mold as described herein results in consistent compaction of the material inside the mold. Alternatively, the compaction is performed in different ways, although other compacting techniques may result in different compaction quality. For example, a first compacting wall can be moved to a locked position before moving a second compacting wall to a locked position. As another alternative, different amounts of force can be applied to different parts of the compacting side walls. As another alternative, only one wall is moved during compaction. As another alternative, more than two walls are moved.

Referring now to FIGS. 4A and 4B, an example locking mechanism by which compacting walls can be locked in place is shown. As shown in FIG. 4A, during compaction the flange 340 remains raised and the flange tip 345 slides along the surface of the shaft 360 (which, in this example, is integrated into compacting wall 300). As shown in FIG. 4B, the flange 340 drops and engages with the slot 350 in the shaft 360 when the flange tip 345 is lined up with the slot 350. In this way, the compacting wall 300 is locked in place when it reaches a desired position, and the pressure exerted by the compactor on the compacting wall can be released while the locked compacting wall maintains pressure on the mixture within the mold. In one implementation, four locking flanges are used, two for each compacting wall 300, 302, as shown in FIG. 2. Alternatively, more or fewer locking flanges can be used, or the flanges can be arranged differently than the example shown in FIG. 2. Furthermore, the example locking mechanism shown in FIGS. 4A and 4B can vary depending on implementation. For example, a locking mechanism other than a locking flange can be used. As an alternative to using a locking mechanism, pressure can continue to be exerted on the compacting wall or walls of the mold during compacting and/or curing, and the locking mechanism can be omitted.

In one implementation, the flanges 340 engage in a locked position at a desired compression level. The desired compression can vary depending on implementation and depending on desired specifications of the finished block. In one implementation, the flanges 340 for each side wall lock in place when the corresponding side wall has been moved approximately 4.75 inches toward the center of a mold in which the uncompacted side walls are approximately 25.5 inches apart, resulting in a distance of 16 inches between the side walls when the mold is in a compacted state.

Locking of the compacting walls can indicate to a human operator or an automated system that external pressure on the compacting walls can be ceased. For example, a human operator can reduce or remove hydraulic pressure from the compacting walls when the operator sees or hears the flanges 340 lock into the slots 350. The operator also can be signaled in some other way, such as by some other visual signal (e.g., flashing light, pressure gauge, or computer display) or audio signal (e.g., buzzer, horn, electronic tone, synthesized speech). Such signals can be triggered mechanically or by a sensor on one or more of the flanges 340, in one or more of the slots 350, on one or more of the shafts 360, or in some other location. Alternatively, in an automated system, the compactor releases pressure when it receives an electronic signal that indicates that the pressure can be released, such as when one or more walls of the compactable mold are locked in place.

In one implementation, when the compacting side walls 300, 302 are locked in place, the hydraulic pressure is released and the two pressure plates 610 (FIGS. 3A and 3B) are withdrawn to return to an "open" position (not shown). In other words, in their open position, the pressure plates are no longer in contact with the compacting side walls. The flanges 340 can be unlocked, such as when a cured block is to be removed from the mold and/or the mold is to be disassembled.

II. Compactable Mold

Compactable molds for forming building blocks are described herein. In one implementation, a compactable mold comprises a frame, two end walls, and two compacting side walls. Each end wall allows insertion and removal of a cylindrical shaft or tube that extends at least the length of the block (sometimes referred to herein as a "center tube"). A side wall structure corresponding to each compacting side wall comprises the corresponding side wall itself and a side tube structure. Each side tube structure comprises three shafts or tubes extending towards the center of the mold cavity (sometimes referred to herein as "side tubes"). Locking mechanisms hold the compacting side walls in place under compression and hold the end walls in place. The compactable mold also includes a removable mold bottom, a removable mold lid, mold lid locks, and a loop, magnet plate, or other device built into the mold lid for lifting the lid to enable mold cleaning and filling. In one implementation, the end walls are not compacting walls but can be moved to facilitate unmolding of a block. Alternatively, a compactable mold can have compacting end walls. As another alternative, both the side walls and the end walls are compacting walls and allow compaction in two dimensions. As another alternative, the side walls, end walls, mold lid and/or mold bottom can be used for compacting to allow compaction in three dimensions. Alternatively, compaction of the mold is performed in some other way.

The mold walls (including the end walls, side walls, mold lid and mold bottom) can be shaped to produce molded blocks of a desired shape, and tubes extending from the walls can be used to create tubes or cavities within a molded block. After curing, molded blocks can allow interlocking and introduction of reinforcing materials via these tubes or cavities without further modifications (such as drilling, cutting or shaping) in the factory or in the field.

Referring again to the example shown in FIG. 2, a frame 110 supports the following elements: two shaped end walls 200, 202 with holes 210 of a diameter enabling the insertion and removal of a round, center tube 220 that, when in place within the mold 100, extends through the length of the mold 100; two shaped, compacting side walls 300, 302; a flat mold base 380 and a removable mold lid 390. Each side wall 300, 302 forms part of a side wall structure that also comprises three side tubes (311, 312, 313 and 321, 322, 323, respectively).

As shown, the center tube 220 and side tubes 311, 312, 313, 321, 322, 323 have circular cross sections, but other kinds of tubes can be used. For example, tubes having an elliptical or polygonal cross section. Furthermore, the arrangements of the tubes can be adjusted depending on implementation. For example, the tube that extends through the length of the mold need not be central, but may instead be positioned closer to either side of the mold and/or closer to either the top or the bottom of the mold. Repositioning the various tubes can be helpful for creating molds for producing different kinds of blocks.

In the example shown in FIG. 2, the side tubes 311, 312, 313, 321, 322, 323, are fixed to side tube structures so that they may be moved simultaneously during compacting or during mold assembly or disassembly. The side tube structures are connected to the side walls 300 via telescoping connectors such that the side walls and the side tube structures may move independently, but will not become disconnected. In one implementation, the removable mold lid 390 includes lid locks 391 and a magnet plate 392 built into the removable mold lid 390 for lifting it with a magnetic lid lifter (not shown). Alternatively, the removable mold lid 390 can be fitted with a loop or some other feature to allow lifting of the lid. Or, the lid can be removed in some other way. The removable mold lid 390 can be removed, for example, to allow an empty mold to be filled with a mixture to be compacted or to disassemble a filled mold.

Figure 5:
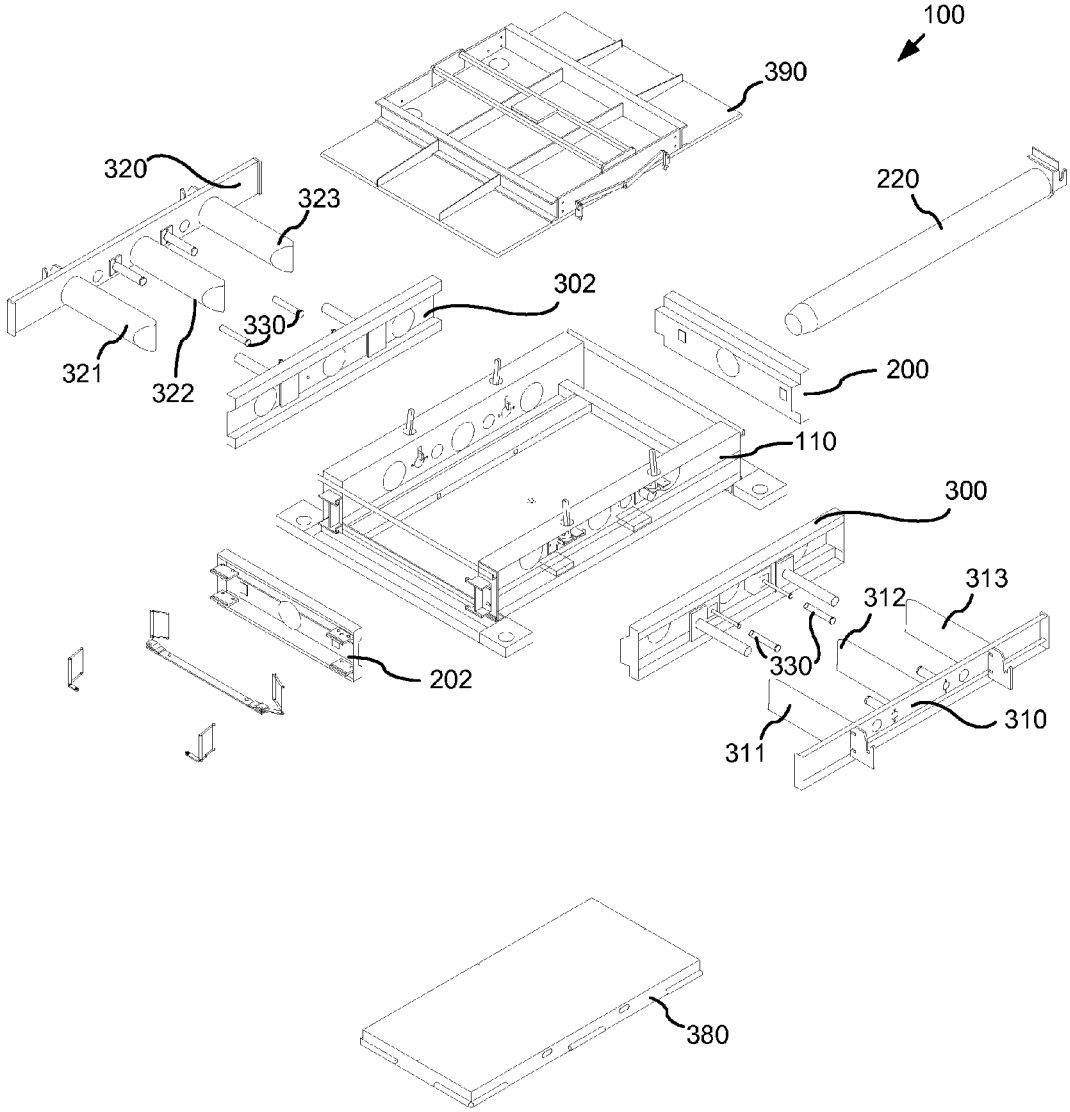
FIG. 5 is a top perspective exploded view of components of the mold of FIG. 2.

FIG. 5 is a top perspective exploded view of components of the mold of FIG. 2. In the example shown in FIG. 5, the mold frame 110, two end walls 200, 202, the center tube 220, two side walls 300, 302, side tube structures 310 and 320, the mold base 380 and the mold lid 390 are shown fully separated from one another. In an assembled mold (not shown in FIG.

5), the side tube structures 310 and 320 are connected to the side walls 300, 302 by the telescoping connectors 330. The telescoping connectors 330 can be replaced with springs or other connection hardware suitable for keeping the side walls 300, 302 connected to the side tube structures 310, 320.

In one implementation, the mold base is approximately 54.6 inches long, 26.4 inches wide, and 3.1 inches high; the center tube is approximately 62 inches long and 6 inches in diameter; the side tubes are 19.5 inches long and 6 inches in diameter; the side tube structure is approximately 58 inches long, 24 inches wide and 6.5 inches high; the side walls are each approximately 48.9 inches long and 9.9 inches high, with widths approximately 15.3 or 13.8 inches high, depending on shape; the end walls are each approximately 31.3 inches long and 9.9 inches high, with widths approximately 4.8 or 3.8 inches high, depending on shape; the lid is approximately 57.2 inches long, 44.3 inches wide and 5.6 inches high; the main frame of the mold is approximately 66 inches long, 54 inches wide and 17.2 inches high; and compaction of the mold results in a lightweight concrete mixture being compressed to approximately 57% of its initial, uncompressed original volume. However, these dimensions are only examples and can be varied depending on mold design choices, block ingredients, and other factors.

Figure 6:
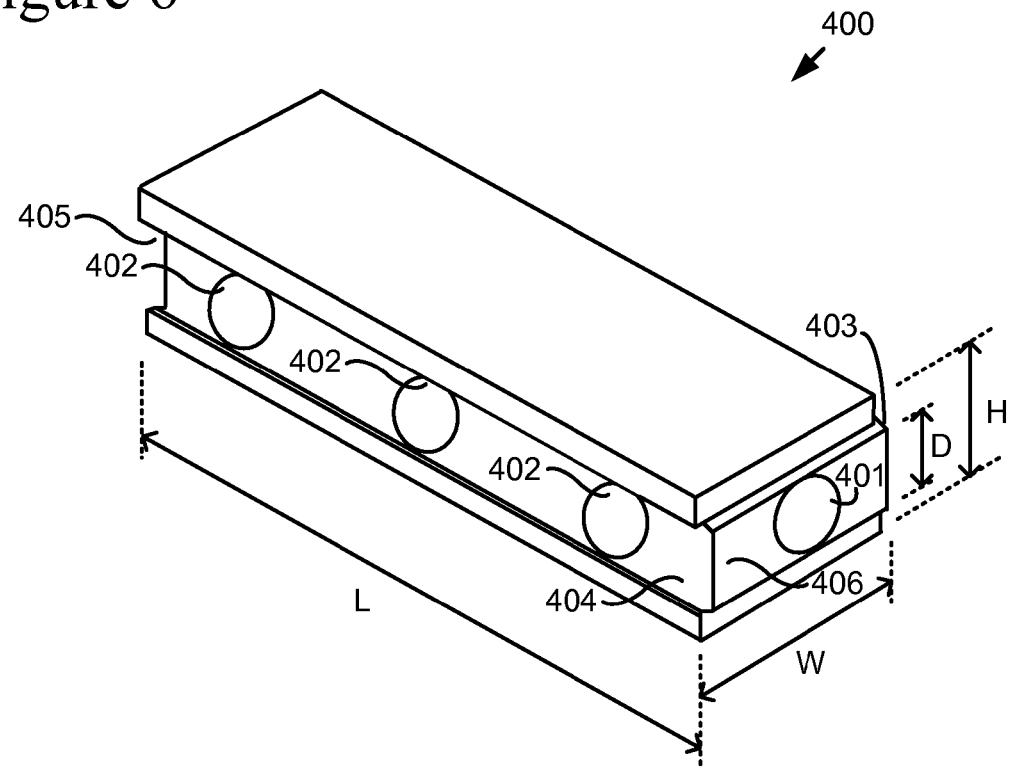
FIG. 6 is a perspective view of a block molded using a mold according to one implementation.

FIG. 6 is a perspective view of a building block 400 (which also can be referred to as a construction block, construction panel, building panel, etc.) molded in a compactable mold such as the mold 100 described with reference to FIG. 2 and FIG. 5. In the example shown in FIG. 6, construction block 400 has shaping that allows the block to interlock with other similarly shaped blocks and has round cavities through its length and width that allows introduction of materials such as reinforcing bars and/or wet cement to increase the structural integrity of walls built with the interlocked blocks. Construction block 400 exists in the general form of a rectangle having a length dimension L, a width dimension W, and a height dimension H, which corresponding to the y-, x-, and z-axis in conventional three-dimensional graphic representations, respectively. In the example shown in FIG. 6, a round, central cavity 401 having a diameter D extends along the length of the block. The cavity 401 is formed by center tube 220 (see, e.g., FIG. 2 and FIG. 5). Three round cavities 402 having diameters D extend through the width of the block, formed by side tubes 311, 312, 313, 321, 322, 323 (see, e.g., FIG. 2 and FIG. 5). The round cavities 402 intersect with the central cavity 401. Reinforcing material such as steel bars and/or wet cement may be introduced (e.g., in vertical and/or horizontal dimensions to increase the structural strength of resulting walls) into the cavities 401, 402 or longer cavities formed by interlocking and/or aligning blocks such that the cavities of two or more interlocked blocks are aligned.

Referring again to FIG. 6, the building block 400 has particular shaping along its right side 403, left side 404, distal end 405, and proximal end 406 to allow the building blocks to interlock (in vertical and horizontal dimensions) during construction. In the example shown in FIG. 6, this shaping results from attributes of a mold such as mold 100 (see, e.g., FIG. 2 and FIG. 5).

Referring again to FIG. 2, the mold 100 includes four heavy-duty flanges 340. When the compacting side walls 300, 302 are moved toward the center of the mold to a sufficient extent, the flanges 340 engage with slots in the shafts 360 to lock the compacting side walls in place, as shown in FIGS. 4A and 4B and described in detail in Section I, above. As shown in FIGS. 3A and 3B and described in detail in Section I, above, a mold such as mold 100 can be compacted in one or more dimensions using a compactor. Although the example shown in FIGS. 3A and 3B involves a hydraulic compactor that exerts pressure on compacting side walls 300, 302, a compactor also can be used to exert pressure on end walls, a top wall and/or a bottom wall for compaction in one or more dimensions.

Figure 7A:
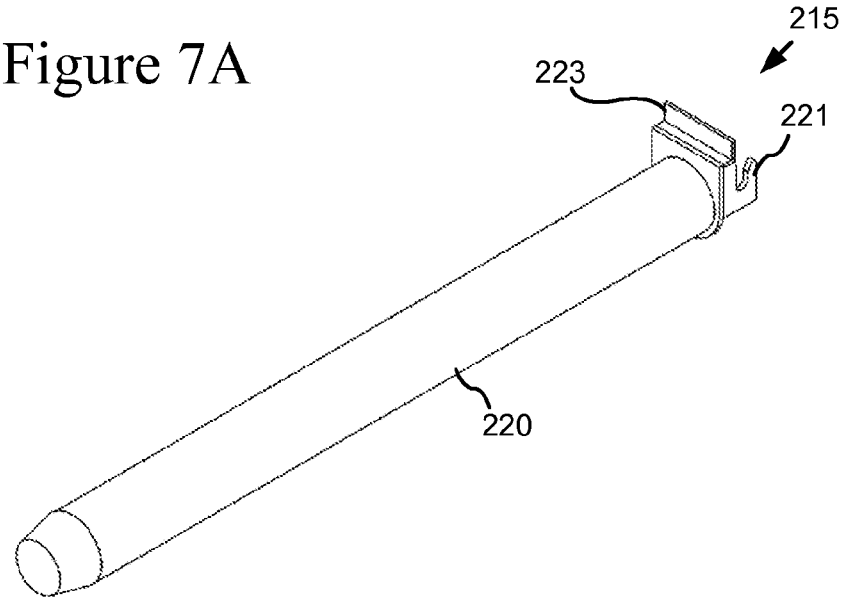
FIG. 7A is a top perspective view of a center tube structure for a mold according to one implementation.
Figure 7B:
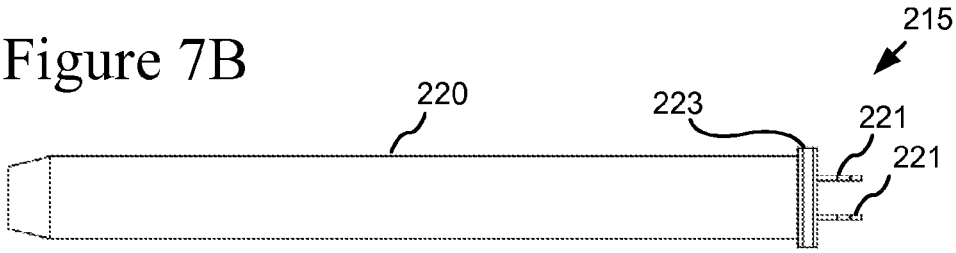
FIG. 7B is a top plan view of the center tube structure of FIG. 7A.
Figure 7C:
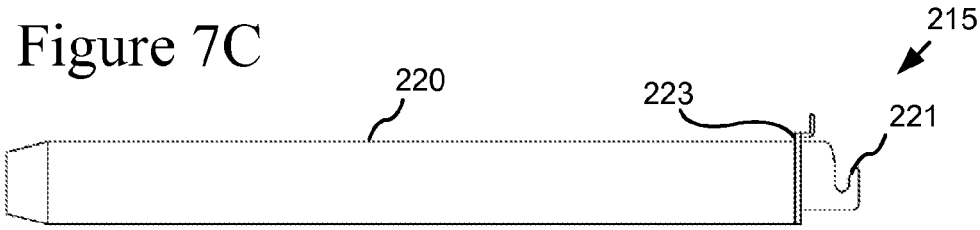
FIG. 7C is a side elevation view of the center tube structure of FIG. 7A.
Figure 7D:
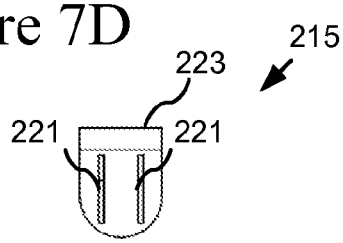
FIG. 7D is a rear elevation view of the center tube structure of FIG. 7A.

FIG. 7A is a top perspective view of a center tube structure 215 for a mold according to one implementation, FIG. 7B is a top plan view of the center tube structure 215 of FIG. 7A, FIG. 7C is a side elevation view of the center tube structure 215 of FIG. 7A, and FIG. 7D is a front elevation view of an end wall of the center tube structure 215 of FIG. 7A. As described above, a round, central cavity that extends the entire length of a molded block can be formed by a center tube 220 (see, e.g., FIG. 2 and FIG. 5).

In the example shown in FIGS. 7A, 7B, 7C and 7D, the center tube 220 is tapered at one end and has a tube end wall 223 attached to the tube opposite the tapered end. However, the tapering and the tube end wall 223 are not required. Two plates shaped as upward-facing hooks 221 are attached to tube end wall 223. The hooks 221 can be used to facilitate insertion and/or removal of the center tube 220 from the mold, but are not required. In one implementation, during automatic disassembly and reassembly of a mold 100, a steel bar integrated into a mold disassembly and reassembly apparatus interacts with the hook-shaped plates 221 (by pulling or pushing) such that the center tube 220 can be extracted from, or introduced into, the mold 100. Alternatively, no hooks, a single hook or more hooks can be used. As another alternative, the center tube 220 can be replaced with a solid shaft. As another alternative, the center tube 220 can be non-cylindrical. As another alternative, several tubes can run between end walls of the mold to create additional cavities in a molded block.

Figure 8A:
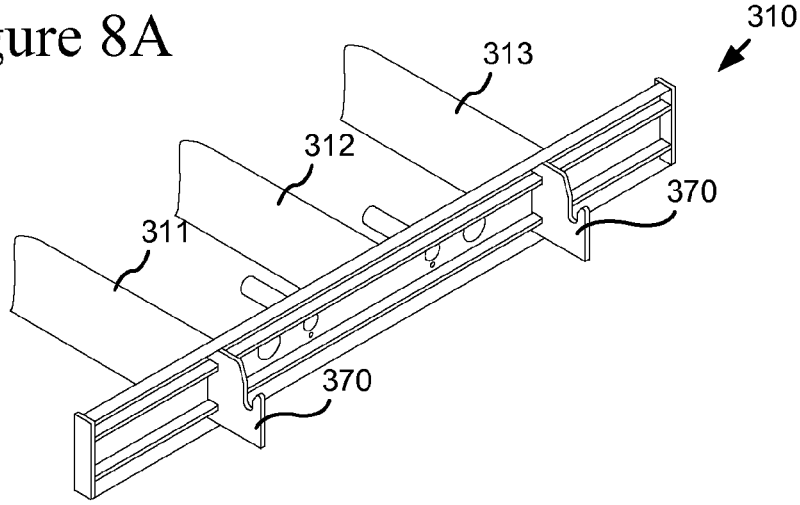
FIG. 8A is a top perspective view of a side tube structure for a mold according to one implementation.
Figure 8B:
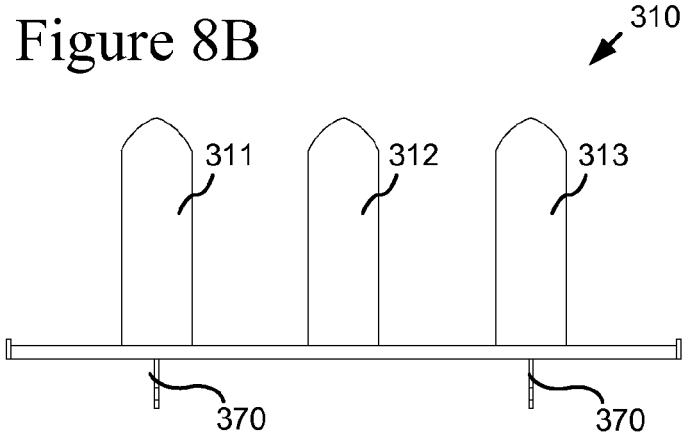
FIG. 8B is a top plan view of the side tube structure of FIG. 8A.
Figure 8C:
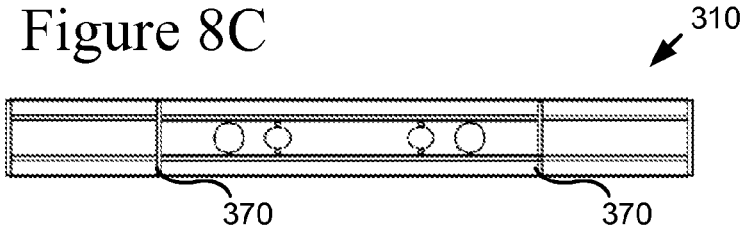
FIG. 8C is a rear elevation view of the side tube structure of FIG. 8A.
Figure 8D:
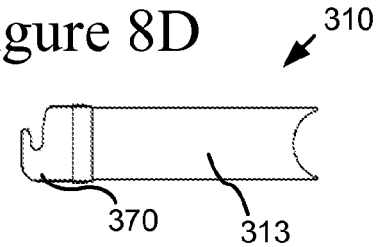
FIG. 8D is a side elevation view of the side tube structure of FIG. 8A.

FIG. 8A is a top perspective view of a side tube structure 310 for a mold according to one implementation, FIG. 8B is a top plan view of the side tube structure 310 of FIG. 8A, FIG. 8C is a rear elevation view of the side tube structure 310 of FIG. 8A, and FIG. 8D is a side elevation view of the side tube structure 310 of FIG. 8A. As described above, cavities that extend the entire width of a molded block can be formed by side tube structures 310 and 320 (see, e.g., FIG. 2 and FIG. 5). Alternatively, a compactable mold does not include side tube structures 310 and 320.

In the example shown in FIGS. 8A, 8B, 8C and 8D, side tube structure 310 comprises three side tubes 311, 312 and 313. Two plates shaped as upward-facing hooks 370 are attached to side tube structure 310. Similar hooks are attached to side tube structure 320 (not shown). The hooks 370 can be used to facilitate insertion and/or removal of a side tube structure 310 from the mold. However, the hooks 370 are not required for forming a molded block. In one implementation, during automatic disassembly and reassembly of a mold 100, a bar integrated into a mold disassembly and reassembly apparatus interacts with the hooks 370 (by pulling or pushing) such that the side tube structure 310 can be extracted from, or introduced into, the mold 100. Similarly, side tube structure 320 can be extracted from, or introduced into, the mold 100. In one implementation, the side tube structures 310 and 320 can be simultaneously extracted from, or introduced into, the mold 100. Alternatively, no hooks, a single hook or more hooks can be used.

Figure 9:
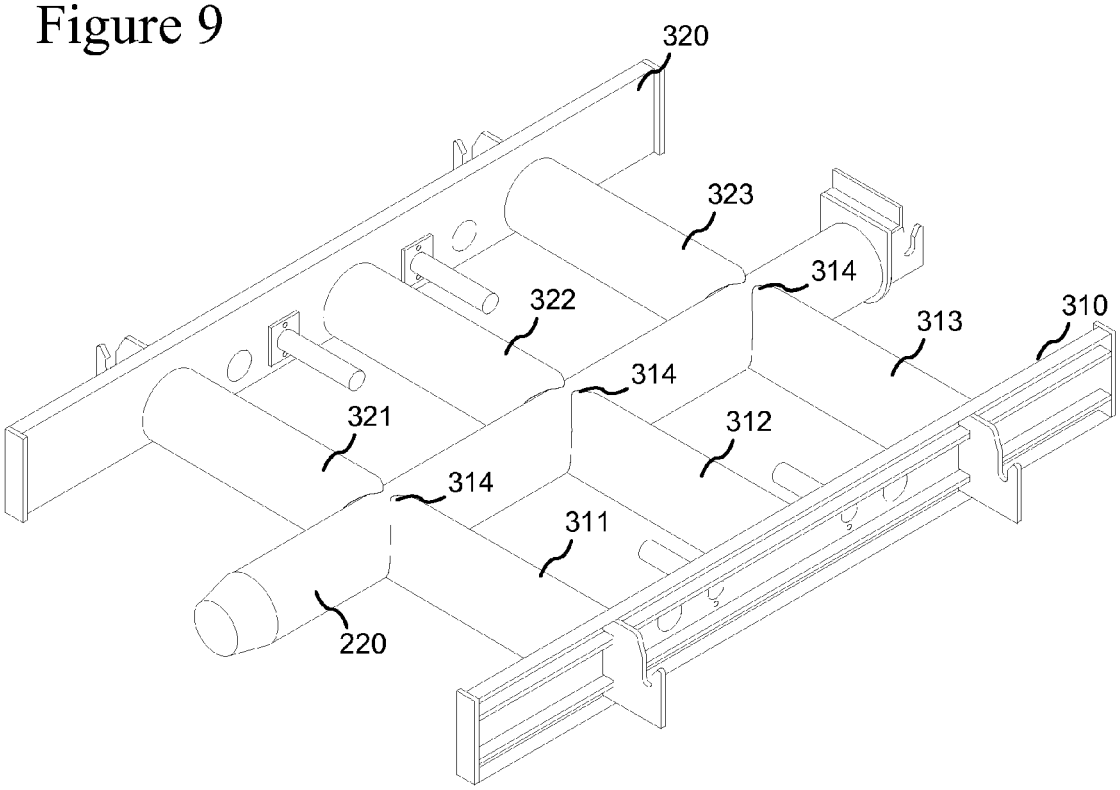
FIG. 9 is a top perspective view of side tube structures having side tubes abutting a center tube for a mold according to one implementation.
Figure 10A:
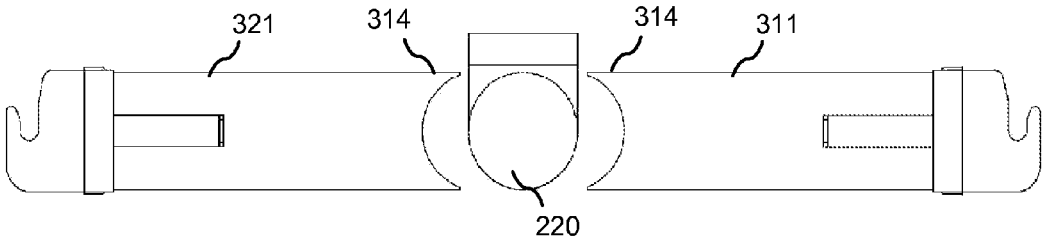
FIG. 10A is a side elevation view of side tube structures having side tubes separated from a center tube for a mold according to one implementation.
Figure 10B:
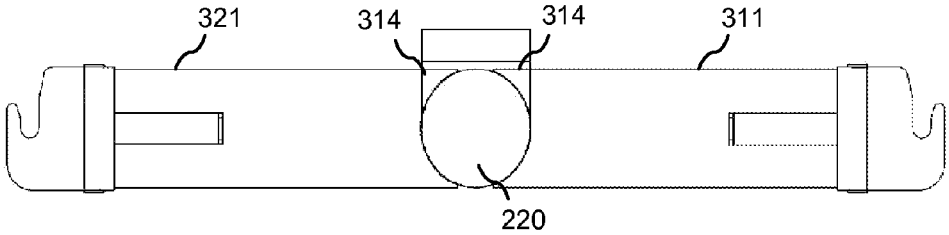
FIG. 10B is a side elevation view of side tube structures having side tubes abutting a center tube for a mold according to one implementation.

Referring now to FIGS. 9, 10A and 10B, details of side tubes on opposite sides of a compactable mold are shown. FIG. 9 is a top perspective view of side tube structures 310, 320 having side tubes 311, 312, 313, 321, 322, 323 abutting a center tube 220 according to one implementation. In FIG. 9, compacting side walls are not shown. FIG. 10A is a side elevation view of side tubes 311, 321 separated from the center tube 220 according to one implementation, and FIG. 10B is a side elevation view of side tubes 311, 321 abutting the center tube 220 according to one implementation. Each side tube has concave shaping at the proximal tip 314. In one implementation, the concave shaping is common to all side tubes (e.g., side tubes 311, 312, 313, 321, 322, 323). The concave shaping allows each side tube to meet and engage precisely with the round walls of the center tube 220 when the mold 100 is assembled.

Figure 11A:
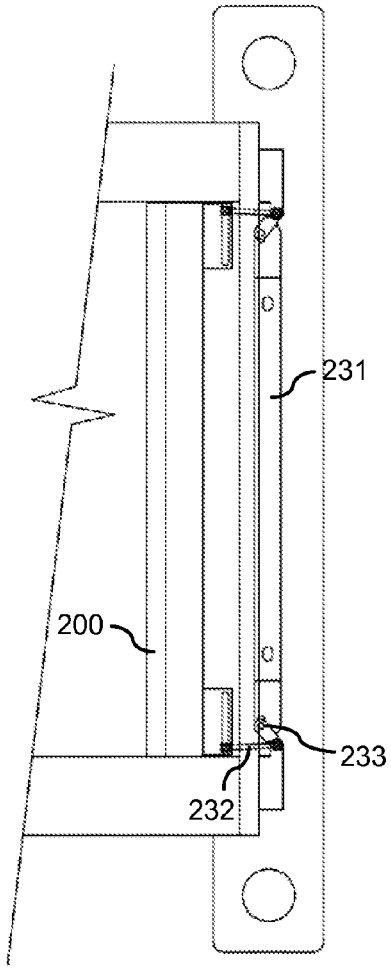
FIG. 11A is a top plan view of an end wall having a locked hinge mechanism for a mold according to one implementation.
Figure 12A:
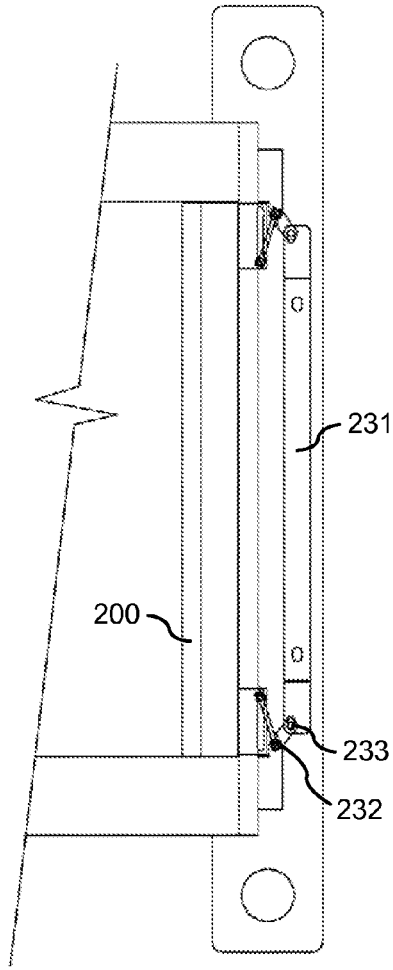
FIG. 12A is a top plan view of an end wall having a released locking hinge mechanism for a mold according to one implementation.
Figure 11B:
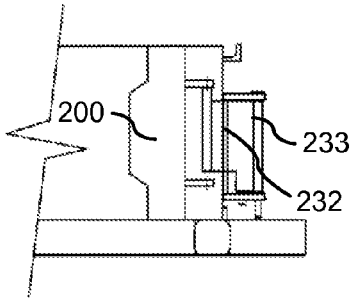
FIG. 11B is a side elevation view of the end wall having a locked hinge mechanism of FIG. 11A.
Figure 12B:
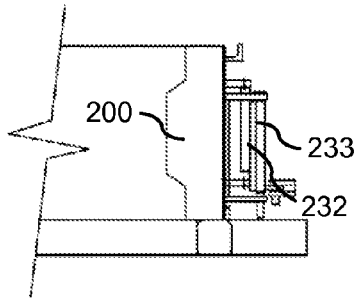
FIG. 12B is a side elevation view of the end wall having a released locking hinge mechanism of FIG. 12A.

Referring now to FIGS. 11A, 11B, 12A and 12B, in one implementation, end wall assemblies include hinged locking mechanisms connected to end wall 200 and end wall 202 (not shown). FIG. 11A is a top plan view of an end wall having a locked hinge mechanism for a mold according to one implementation, FIG. 11B is a side elevation view of the end wall having a locked hinge mechanism of FIG. 11A, FIG. 12A is a top plan view of an end wall having a released locking hinge mechanism for a mold according to one implementation, and FIG. 12B is a side elevation view of the end wall having a released locking hinge mechanism of FIG. 12A. The hinged locking mechanism comprises a bar 231 (e.g., a steel bar) connected by hinges 232 and by associated corner pins 233 to the end wall 200. Prior to compacting material in the mold 100, the bar 231 is pulled out (e.g., by an automated system or by human operators) to set the hinges in their open, locked position. (See FIGS. 11A and 11B) This moves the end walls 200, 202 slightly toward the midline of the mold 100 and locks the end walls 200, 202 in that position. In one implementation, after the mold 100 and contained mixture have been compacted, and after the resulting building block has cured sufficiently, a mold disassembly and reassembly apparatus interacts with the hinged steel bars 231 such that the hinges 232 are unlocked, releasing the end walls 200 from their locked position. When released, the end walls 200, 202 move slightly outward, away from the midline of the mold 100 and the ends of the contained building block. (See FIGS. 12A and 12B.) This change in position is sufficient to separate the end walls from the cured building block, allowing the cured building block to be removed from the mold 100. Alternatively, locking mechanisms are not used for the end walls. As another alternative, different locking mechanisms can be used for the end walls. The hinged steel bars 231 can be flat, round or some other shape, and the small holes shown in the hinged steel bars are not required. One or more springs can be added to the locking mechanism to help push toward the frame and hold the end walls 200, 202 in place.

In one implementation, the mold is used in conjunction with a hydraulic compactor (see Section I, above) and/or an automated mold disassembly and reassembly system (see Section III, below).

III. Techniques and Tools for Mold Assembly and Disassembly

Techniques and tools are described for assembling and disassembling compactable molds such as mold described in Sections I and II above. For example, a mold assembly/disassembly unit automatically disassembles a filled mold (e.g., to release a cured building block from within the mold) and reassembles the mold for reuse. As used herein, the term "disassembly" is understood to include removal of a lid, base, wall, or other single or plural components from a mold. Disassembly, as used herein, does not require complete disassembly of all parts of an assembled or partially-assembled mold. As used herein, the term "assembly" is understood to include adding or connecting a lid, base, wall, or other single or plural components to a mold. Assembly, as used herein, does not require complete assembly of all parts of a mold.

In one implementation, the mold assembly/disassembly unit includes a control unit containing a programmable controller. Mold assembly and/or disassembly can be controlled by computer, manufacturing personnel, or with a combination of computer and human control. For example, manufacturing personnel can start and stop an automated assembly or disassembly process, monitor an assembly or disassembly process, or control an assembly or disassembly process manually using the control unit. The mold assembly/disassembly unit can operate in an automatic mode, in which all steps are automated, in a manual mode, or it can switch between different modes. In manual mode, manufacturing personnel can cause the mold assembly/disassembly unit to complete mold disassembly or assembly one step at a time. In one implementation, when manual mode is selected for assembly or disassembly of one mold, the mold assembly/disassembly unit can be switched to automatic mode for subsequent molds.

Although mold assembly and disassembly are described herein as being performed by a single mold assembly/disassembly unit, mold assembly and disassembly can be performed by more than one unit (e.g., a disassembly unit and an assembly unit) or by units that are not specifically limited in function to assembly and disassembly of molds. In one implementation, the mold assembly/disassembly unit is designed to operate on a mold with specific features and elements. However, the dimensions of the mold can vary (e.g., to produce building blocks of varying thickness). Alternatively, a mold assembly/disassembly unit can operate on molds having different features and/or elements.

Figure 13:
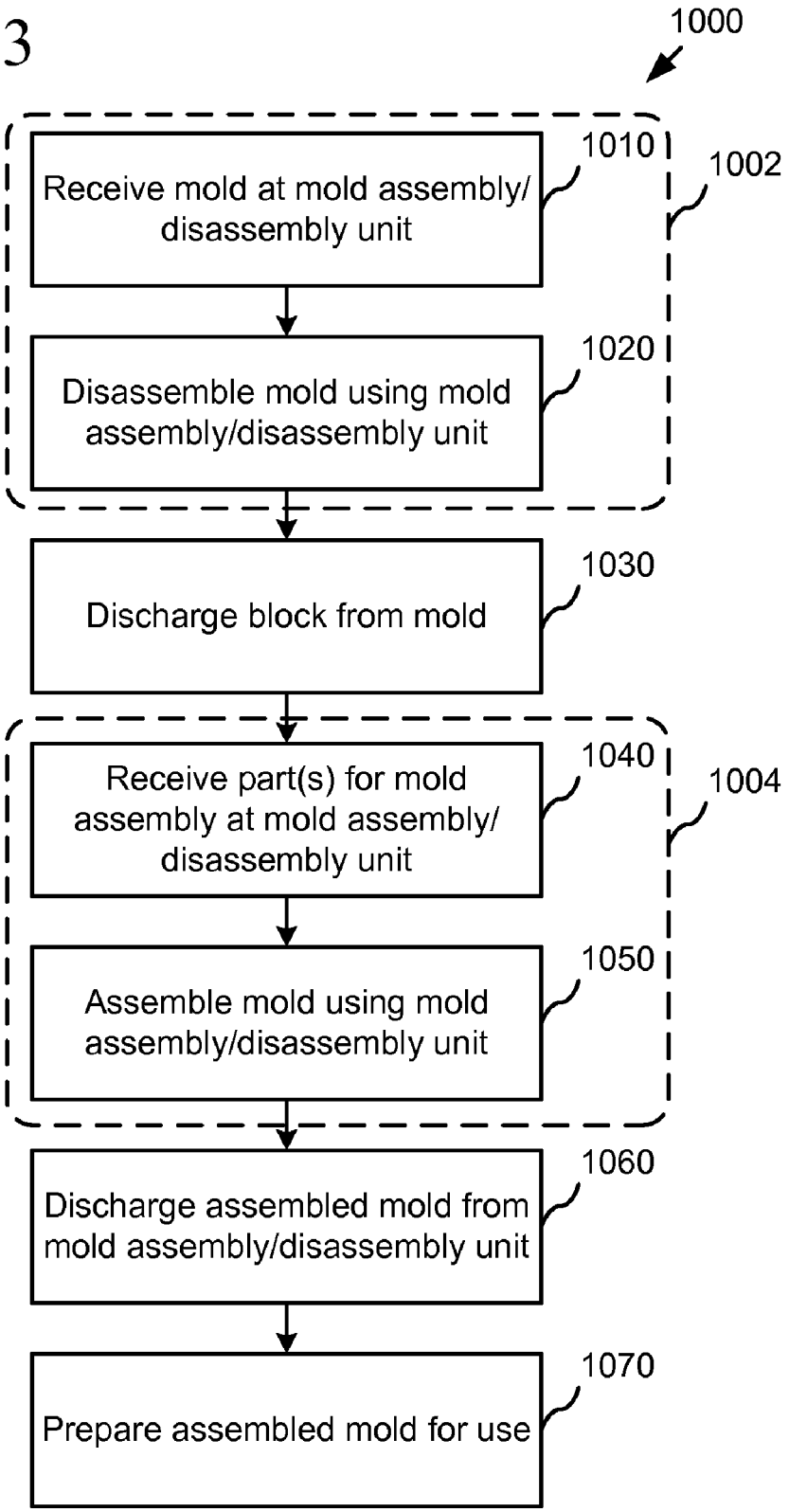
FIG. 13 is a flow chart showing an example technique for assembling and disassembling a mold during a building block manufacturing process according to one implementation.

FIG. 13 is a flow chart showing a detailed technique 1000 for assembling and disassembling a mold during a building block manufacturing process according to one implementation. In the example illustrated in FIG. 13, an assembled, compacted mold initially contains a molded building block, which may be a partially or fully cured block. A basic technique for disassembling a mold containing a molded block is shown within a dashed line at 1002. This basic technique can be performed independently or as part of detailed technique 1000 or another technique. This basic technique also can be performed on an empty mold. At 1010, a mold is received at a mold assembly/disassembly unit. In one implementation, an assembled mold containing a molded building block is loaded into a mold assembly/disassembly unit. At 1020, the mold is disassembled using the mold assembly/disassembly unit.

Referring again to the detailed technique 1000, at 1030, the block is discharged from the disassembled mold. In one implementation, the block rests on the mold base from the disassembled mold as it is discharged onto a conveyor, which transports the block away from the mold assembly/disassembly unit. In the detailed technique 1000 shown in FIG. 13, the mold is disassembled prior to removing the molded block. If the block can be removed from a mold without disassembling the mold, the act of discharging the block from the mold can precede the act of disassembling the mold.

A basic technique for assembling and/or reassembling a mold is shown within a dashed line at 1004. This basic technique can be performed independently or as part of detailed technique 1000 or another technique. At 1040, one or more parts for mold assembly are received at the mold assembly/disassembly unit. For example, in one implementation, a block discharged from a disassembled mold rests on the mold base from the disassembled mold as the block is transported away from the mold assembly/disassembly unit, so a new mold base is loaded into the mold assembly/disassembly unit and the new mold base is used to reassemble the mold. At 1050, a mold is assembled using the mold assembly/disassembly unit.

Referring again to the detailed technique 1000, at 1060 an assembled mold is discharged from the mold assembly/disassembly unit, and the assembled mold is prepared for use. The mold assembly/disassembly unit can then receive another mold for disassembly or receive parts for assembly of a mold.

Figure 14:
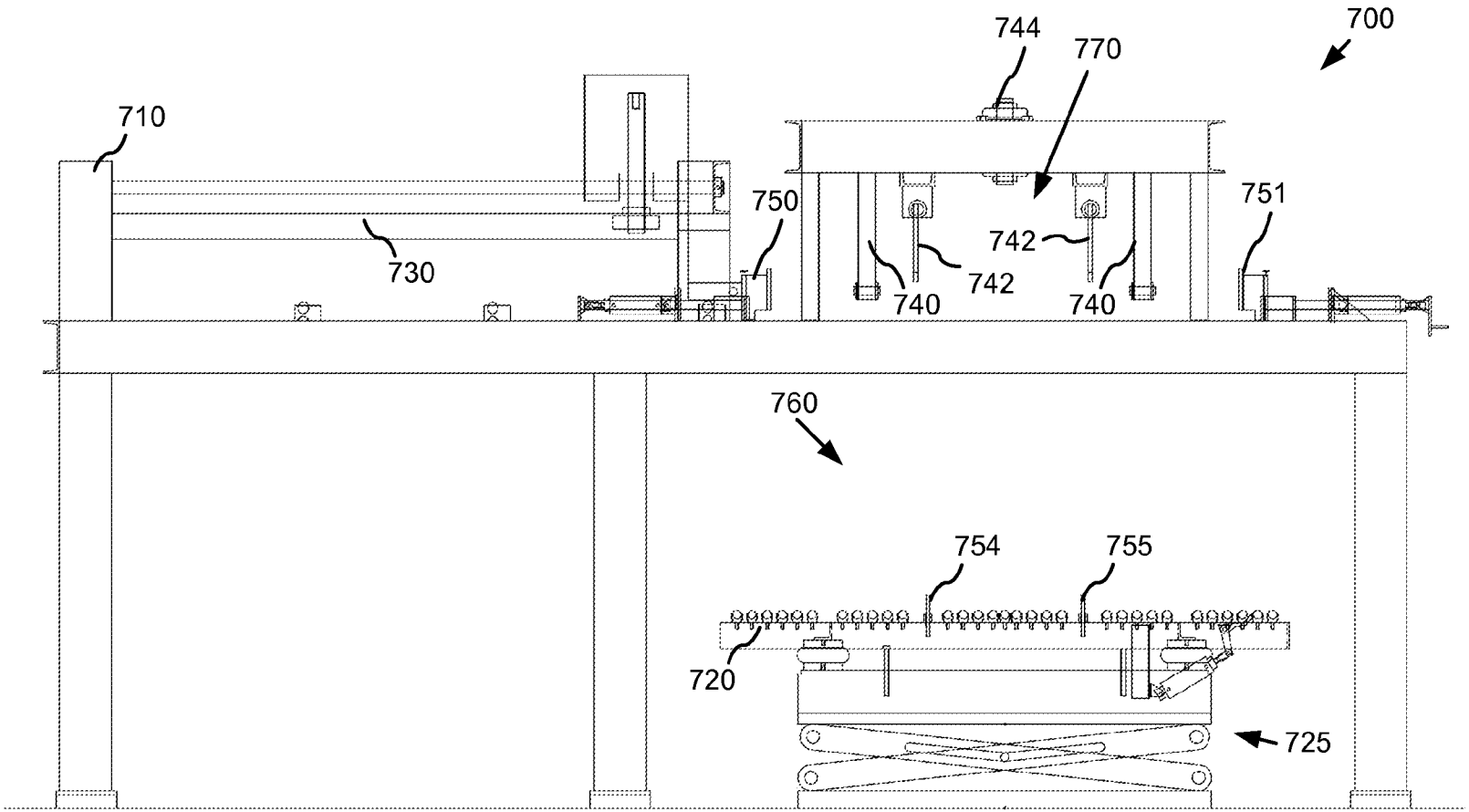
FIG. 14 is a side elevation view of a mold assembly/disassembly unit according to one implementation.
Figure 15:
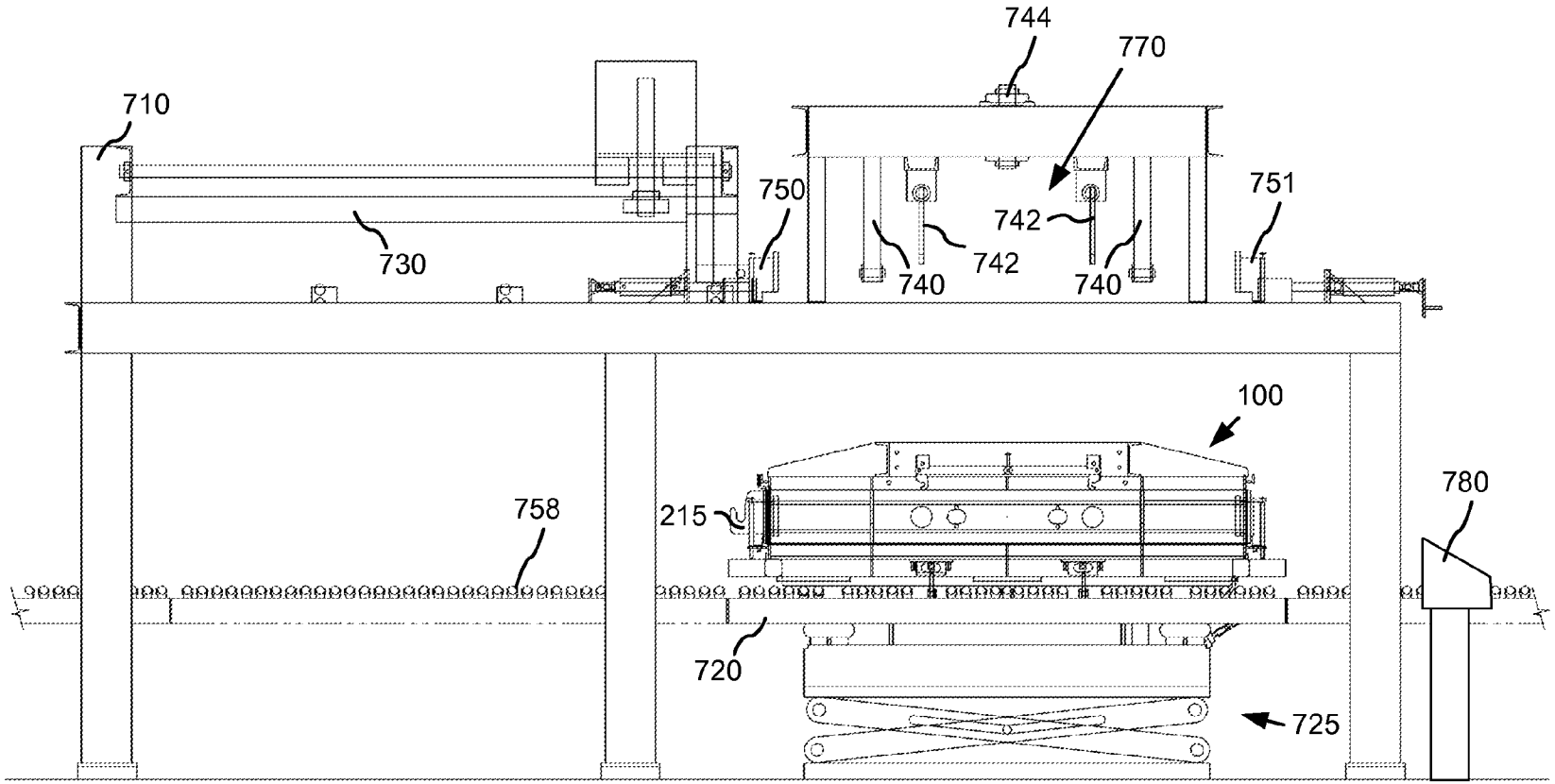
FIG. 15 is a side elevation view of a mold assembly/disassembly unit and an assembled mold according to one implementation.
Figure 16:
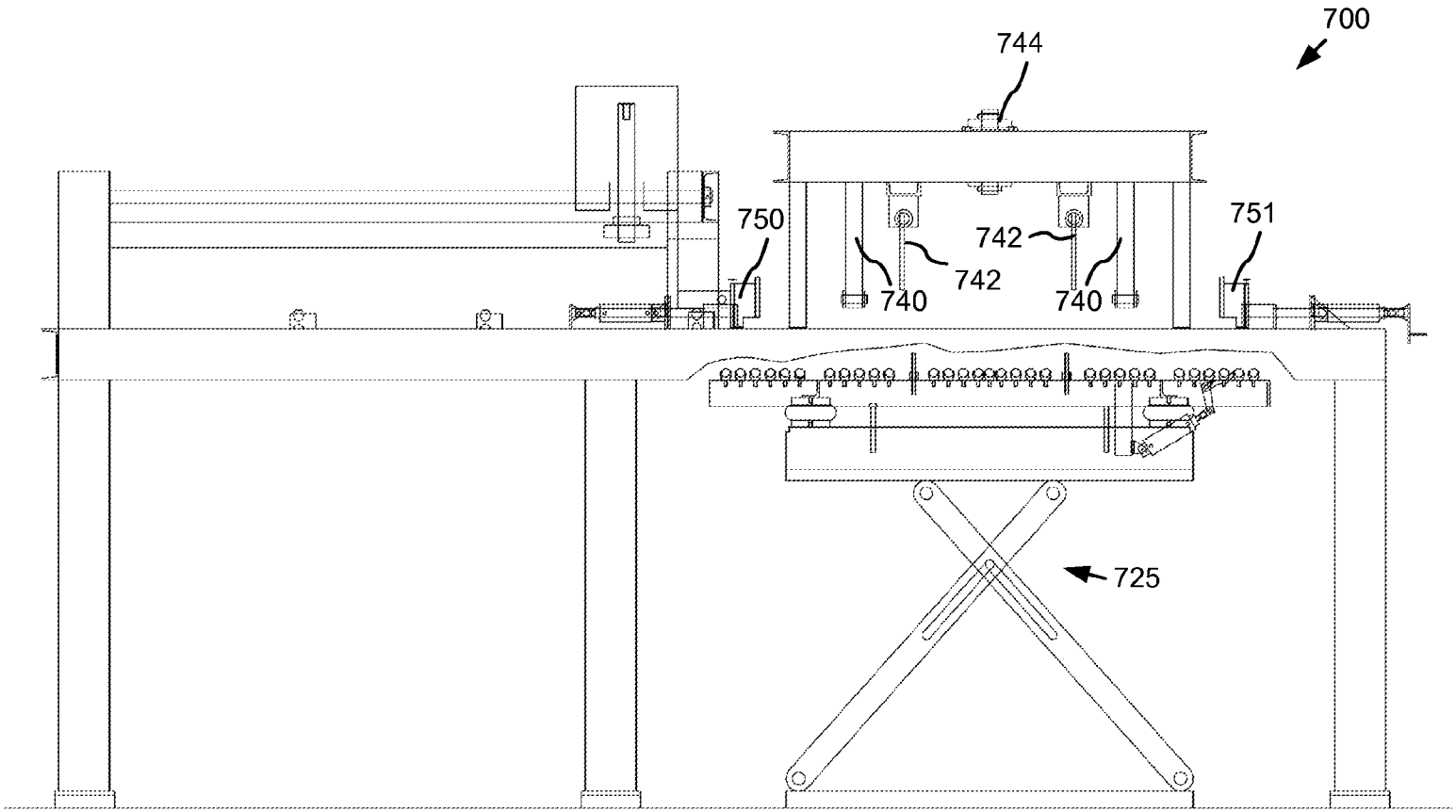
FIG. 16 is a side elevation view of the mold assembly/disassembly unit of FIG. 14 with a scissor-lifter mechanism in an extended or raised position.

FIG. 14 is a side elevation view of a mold assembly/disassembly unit 700 according to one implementation. FIG. 15 is a side elevation view of the mold assembly/disassembly unit 700 and an assembled mold 100 according to one implementation. As shown in FIG. 14, the mold assembly/disassembly unit 700 includes a frame 710 and a table 720 on which the mold 100 (FIG. 15) rests during disassembly of the mold, removal of a molded block, and/or assembly of the mold. The table 720 can be raised and lowered through the action of a scissor lifter 725. In FIG. 14, the scissor-lifter mechanism 725 that raises the table 720 from the lowered load position to the upper working position is shown in its lowered position. FIG. 16 is a side elevation view of the mold assembly/disassembly unit 700 of FIG. 14 with the scissor-lifter mechanism 725 in its extended or raised position.

As shown in FIG. 15, the mold assembly/disassembly unit 700 further includes an elongate arm 730 that can interact with the mold's center tube structure 215, for extraction and insertion of the center tube structure during mold disassembly and assembly.

As shown in FIG. 14, the mold assembly/disassembly unit 700 further includes four side assembly/disassembly arms 740, two on each of the opposite sides of the main frame 710. Two of the side assembly/disassembly arms are shown in FIG. 14. The side assembly/disassembly arms include small rods at the end that interact with hooks on the side wall structures to retract or insert the side tube structures (e.g., side tube structures 310, 320 (FIG. 5)) and to move the side walls (e.g., side walls 300, 302 (FIG. 5)) away from the midline of the mold (e.g., away from a molded block within the mold) during mold disassembly or toward the midline of the mold during mold assembly. The mold assembly/disassembly unit 700 further includes side wall lock release mechanisms 742 for releasing flange locks in an assembled, compacted mold. A motor 744 is used to move the four side assembly/disassembly arms during assembly and disassembly.

As shown in FIG. 14, in one implementation the mold assembly/disassembly unit 700 includes end wall release mechanisms 750, 751 on one side of the frame and two more levers (not shown) on the opposite side of the frame. These levers can be used to interact with hinges on the mold end walls to move the end walls away from a molded building block. The mold assembly/disassembly unit 700 also includes base locks 754, 755 on one side of the table 720 and two more base locks (not shown) on the opposite side of the table to hold the mold frame in place during mold disassembly. The frame 710 of the mold assembly/disassembly unit 700 includes a lower mold loading and discharge area generally indicated at 760 and an upper mold disassembly and reassembly area generally indicated at 770. As an alternative to base locks, the large holes shown in FIGS. 11A and 12A can be used to align the mold during assembly or disassembly unit. For example, when the mold comes up into the mold disassembly and reassembly area, cones on the mold assembly or disassembly unit are inserted into the large holes and align the mold.

In one implementation, anti-drop pins (not shown) just below the upper mold disassembly and reassembly area 770 are used to help hold a mold in the area and prevent it from dropping.

As shown in FIG. 15, a control station 780 can be used to control various aspects of mold assembly, mold disassembly, and/or other aspects of block manufacturing. (In one implementation, control station 780 is located adjacent to the frame 710 of the apparatus 700. Alternatively, the control station 780 can be located somewhere else, such as a control room in a remote location.) The control station 780 allows mold assembly, mold disassembly, and/or other aspects of block manufacturing to be precisely controlled. In one implementation, the control station 780 includes programmable elements (e.g., programmable computer software and/or hardware elements) to allow block manufacturing to proceed in a pre-programmed and orderly way, and a user interface provided on control station 780 allows manufacturing personnel to start, stop or interrupt automatic operation, if needed, to correct errors or faults and restart once the error or fault is corrected. The control station can be implemented, for example, as a special-purpose electronic controller or a general-purpose computer with general-purpose input and output devices such as a mouse, keyboard and display.

Figure 17A:
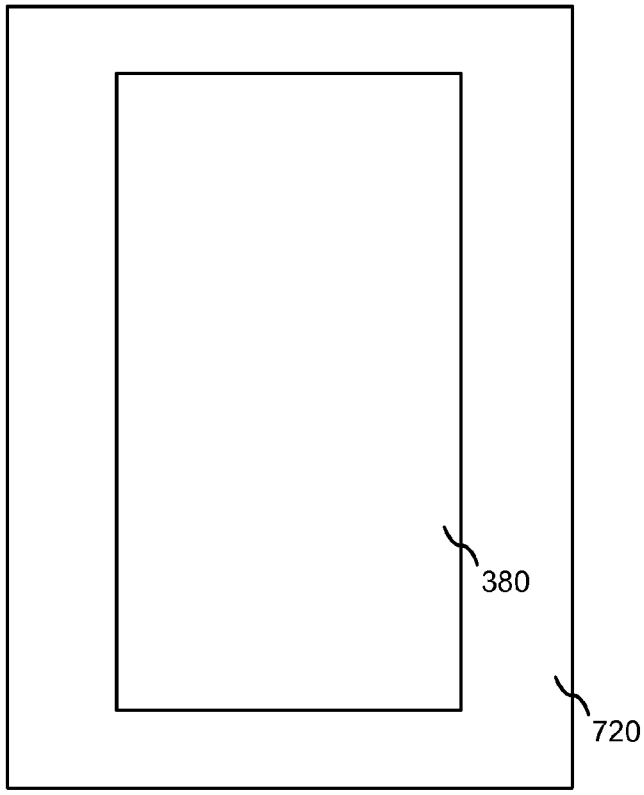
FIG. 17A is a schematic plan view of a table having a mold base resting thereon.

FIG. 17A is a schematic plan view of a table 720 having a mold base 380 resting thereon. In the example shown in FIG. 17A, no base locks are used to hold the mold base 380 in place. Alternatively, the table 720 includes base locks 721 (see FIGS. 17B and 17C) to hold a mold base in place during operation of the mold assembly/disassembly unit. Rollers 758 can be used to facilitate moving molds on and off the table, and can also be used to help move molds along conveyors (see FIG. 15). However, rollers are not required. In one implementation, rollers are omitted and a conveyor belt is used.

Figure 17B:
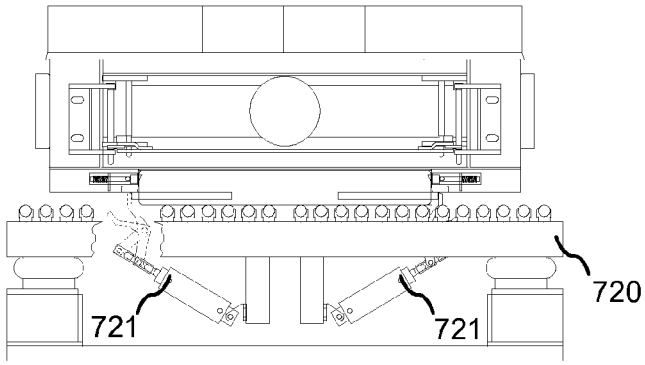
FIG. 17B is a side sectional view of a table and two base locks extending in a lowered and unlocked position above the top surface of the table.
Figure 17C:
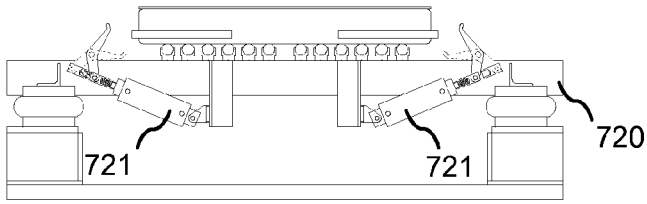
FIG. 17C is a side sectional view of the table and two base locks of FIG. 17B in a raised and locked position

In the example shown in FIGS. 17B and 17C, the base locks 721 are raised and lowered automatically according to signals from control station 780 (FIG. 15) when in an automatic mode. The base locks 721 also can be raised or lowered manually (e.g., by an operator's input to control station 780 or by hand). FIG. 17B is a side sectional view of the table 720 and two base locks 721 extending above the top surface of the table. As shown in FIG. 17B, the locks 721 are in a lowered and unlocked position. FIG. 17C is a side sectional view of the table 720 and two base locks 721 in a raised and locked position. In the examples shown in FIGS. 17B and 17C, the base locks 721 include air cylinders.

Figure 18:
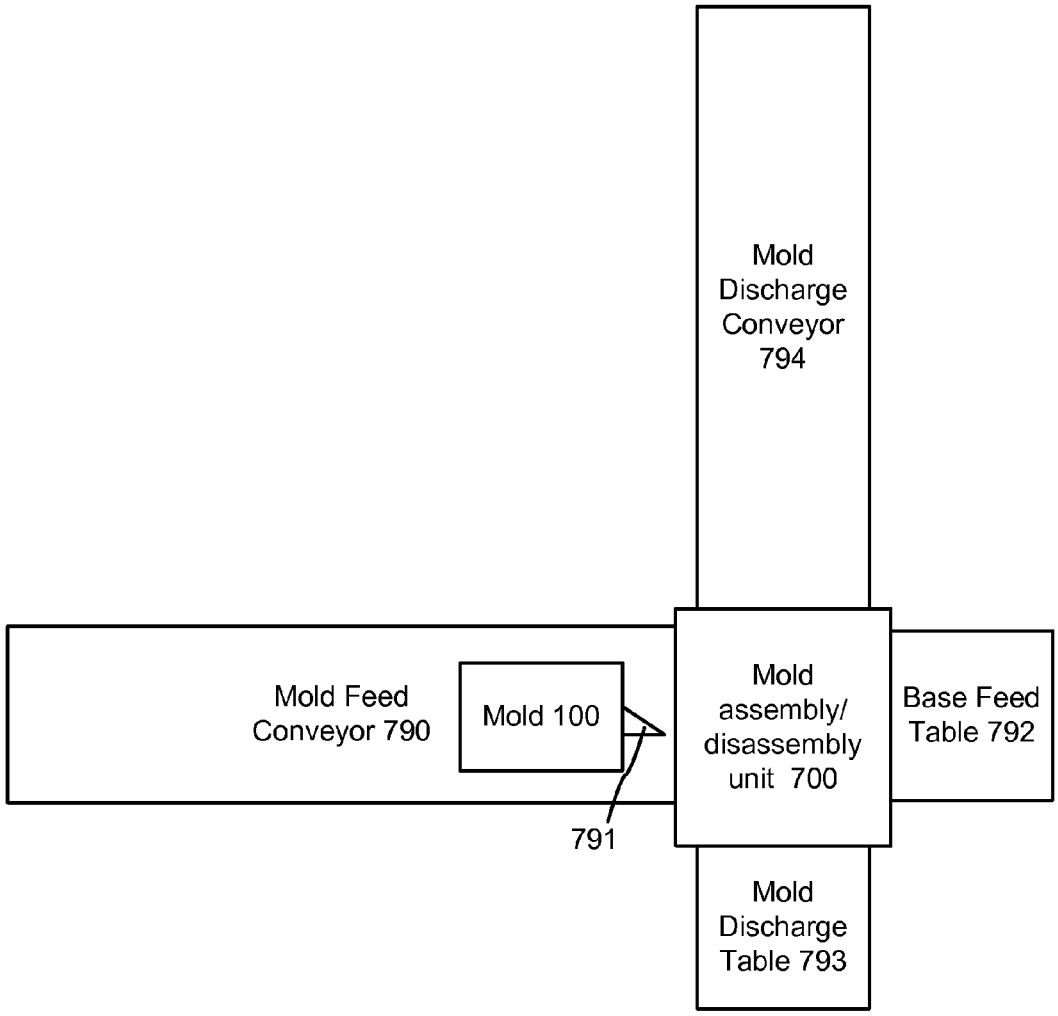
FIG. 18 is a partial schematic view of a block manufacturing facility according to one implementation.

FIG. 18 is a partial schematic plan view of a block manufacturing facility according to one implementation. In the example shown in FIG. 18, a mold feed conveyor 790 feeds an assembled, full mold 100 into the mold assembly/disassembly unit 700. The mold feed conveyor 790 includes a mold lock 791 to hold the mold 100 on the feed conveyor until the mold assembly/disassembly unit 700 is ready to accept mold 100 for disassembly. A block discharge conveyor 794 receives blocks resting on mold bases after the blocks are removed from the mold (e.g., after disassembly of the mold). In the example shown in FIG. 18, a mold base feed table 792 holds an empty mold base ready to be inserted into the mold assembly/disassembly unit 700 for mold reassembly, and a mold discharge table 793 receives reassembled molds ready to be reused. A conveyor could also be used to feed mold bases into the mold assembly/disassembly unit 700. A mold discharge conveyor also can be used to receive re-assembled molds ready to be reused.

Figure 19:
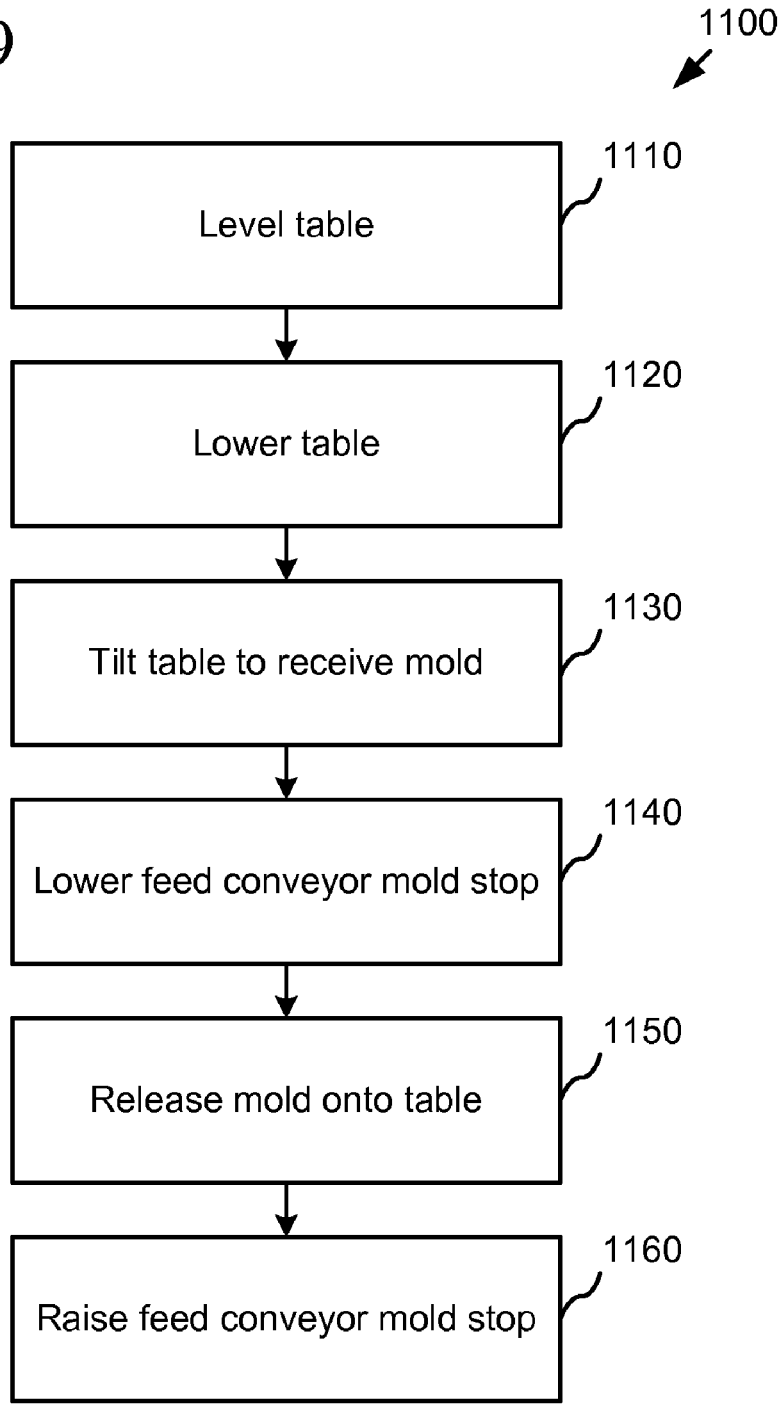
FIG. 19 is a flow chart showing an example technique for loading a full mold into a mold assembly/disassembly unit according to one implementation.

FIG. 19 is a flow chart showing a detailed technique 1100 for loading a full mold into a mold assembly/disassembly unit 700 according to one implementation. In the example illustrated in FIG. 19, the table is leveled at 1110, the table is lowered at 1120 to be at the level of a full mold waiting on the feed conveyor, and the table is tilted at 1130 so that the full mold will slide onto it when released from the conveyor. Alternatively, the table is already at the correct orientation for receiving the full mold and need not be tilted or leveled.

In the example shown in FIG. 19, an operator activates the controller to lower the feed conveyor mold stop at 1140, the mold is released at 1150 from the feed conveyor onto the table, and mold stop is raised to its original position at 1160. Alternatively, the mold stop is automatically lowered to release the mold at a preprogrammed time. As another alternative, the mold stop is omitted.

Base locks can be used to lock the mold in place. Alternatively, the mold rests on the table and is not locked in place. In one implementation, proximity sensors on the table confirm that the mold is in the correct position. Alternatively, proximity sensors are not used.

Figure 20:
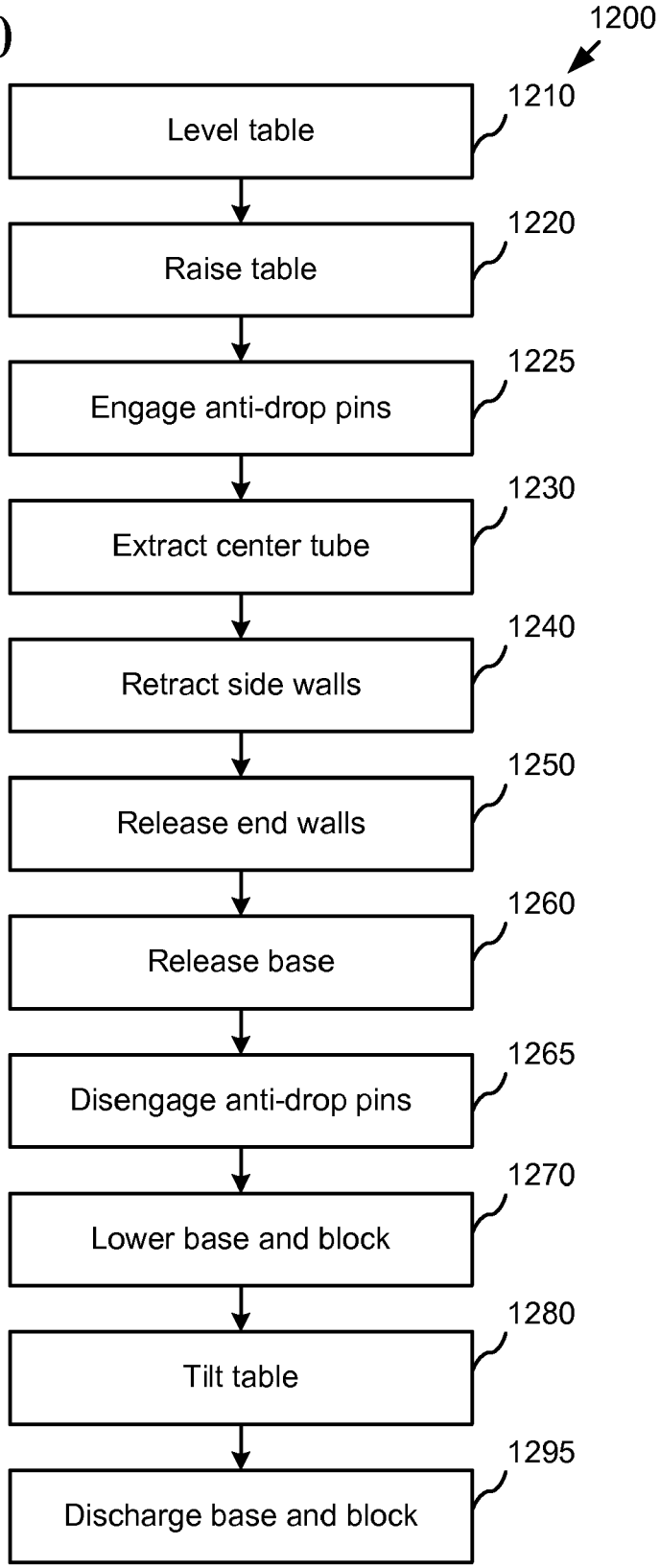
FIG. 20 is a flow chart showing an example technique for removing a block (e.g., a partially or fully cured block) from a mold according to one implementation.

FIG. 20 is a flow chart showing a detailed technique 1200 for removing a block (e.g., a partially or fully cured block) from a mold according to one implementation. The steps shown in FIG. 20 can be performed by an operator interacting with a control station, by hand, automatically, or some combination of automatic and manual operation. In the example illustrated in FIG. 20, the table holding the full mold is leveled at 1210. Alternatively, the table is already in the correct orientation and need not be leveled. At 1220, the table is raised to the upper working position using the scissor lift mechanism, to prepare for disassembly. Alternatively, a mold can be disassembled (such as by hand) without raising the mold into the upper work area. At 1225, anti-drop pins engage to ensure that the mold remains securely in place and does not drop during mold disassembly. Although the anti-drop pins provide an extra measure of safety, such pins are not required. In one implementation, a check is performed to see if the anti-drop pins in the upper work area need to be retracted to allow lifting the mold into the upper work area.

At 1230, the center tube is extracted from the mold and is held away from the work area. For example, referring again to FIG. 15, center tube removal arm 730 is used to extract the center tube structure 215 from the mold 100. At 1240, the side tubes and side walls are retracted. For example, referring again to FIG. 15, side assembly/disassembly arms 740 are used to retract the side tubes and side walls from the mold 100. At 1250, the locking mechanisms (e.g., locking spring hinges) on the end walls are released. For example, referring again to FIG. 15, end wall release mechanisms 750, 751 are used to release the spring hinges of the end walls of the mold 100 simultaneously, allowing the end walls to move away from the ends of the molded block within the mold. The end walls remain attached to the frame of the mold by the hinges. At 1260, the mold base is unlocked from the rest of the mold, at 1265 the anti-drop pins (if used) are disengaged, and at 1270 the mold base and the block resting on it are lowered by the scissor lift mechanism to the level of the discharge conveyor. (The mold lid remains attached to the mold's main frame in the upper work area.)

At 1280, the table is tilted to allow the mold base and the molded block to slide onto the discharge conveyor (1295). In one implementation, rollers on the table facilitate moving the base and molded block from the table to the discharge conveyor. As another alternative, tilting of the table is not required to slide the mold block onto the discharge conveyor. In one implementation, sensors on the table verify that the block has fully discharged from the table.

Figure 21:
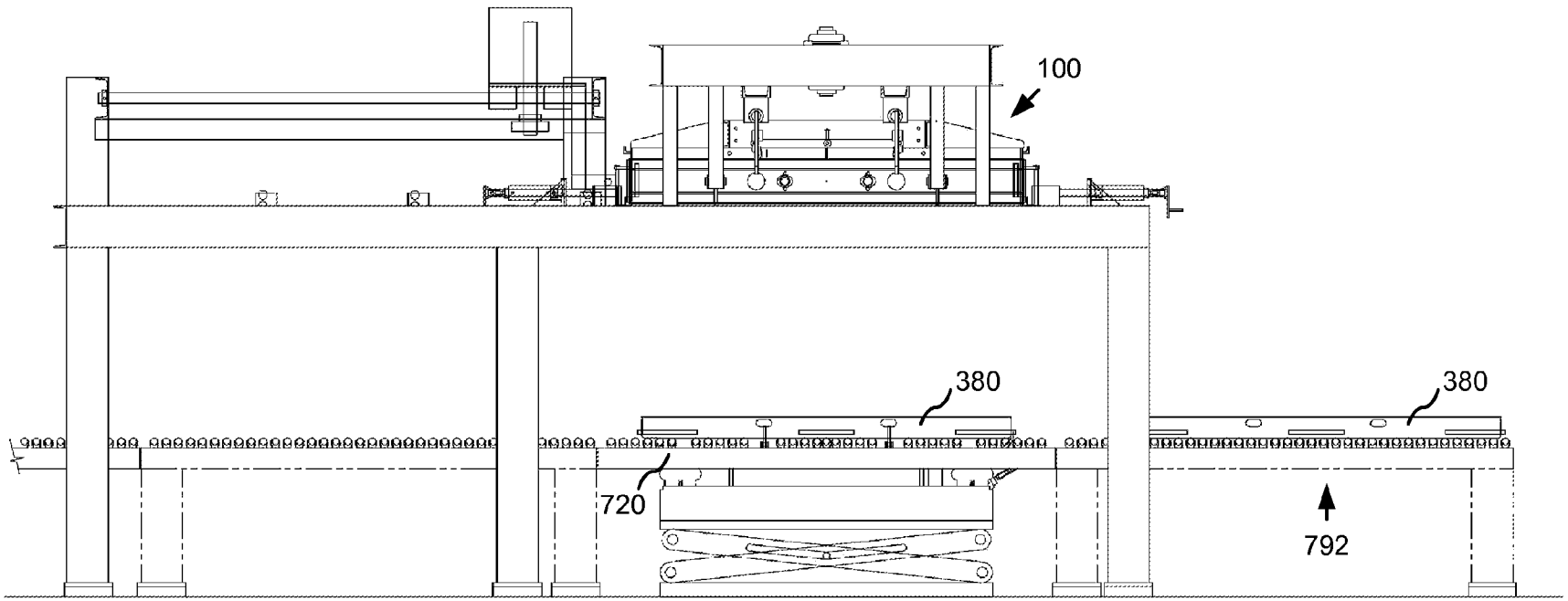
FIG. 21 is a side elevation view of a mold assembly/disassembly unit holding a disassembled mold and a mold base feed table according to one implementation.

FIG. 21 is a side elevation view of a mold assembly/disassembly unit holding a disassembled mold 100 and a mold base feed table according to one implementation. As shown in FIG. 21, a new mold base 380 has been placed on the mold base feed table 792, while another mold base 380 has already been transferred from the mold base feed table to the work table 720. The partially assembled mold 100 (without a base) is in the upper work area. In one implementation, the empty mold base 380 is manually introduced into the apparatus 700 in the direction indicated by the arrow 701 to rest on the table 720.

Figure 22:
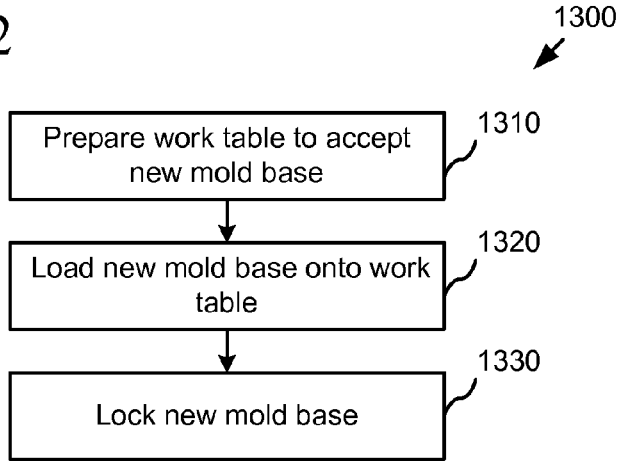
FIG. 22 is a flow chart showing an example technique for loading a new mold base for mold reassembly according to one implementation.

FIG. 22 is a flow chart showing a detailed technique 1300 for loading a new mold base for mold reassembly according to one implementation. The steps shown in FIG. 22 can be performed by an operator interacting with a control station, by hand, automatically, or some combination of automatic and manual operation. In the example illustrated in FIG. 22, at 1310 the work table 720 is leveled to prepare the work table for loading of a new mold base. At 1320, the new mold base is loaded onto the table 720. In one implementation, the new mold base is aligned with base locks on the work table 720. Alternatively, base locks are not used. The new base is locked into position at 1330. In one implementation, proximity sensors on the table verify that the base is in correct position prior to, and after, locking it onto the table. Alternatively, proximity sensors are omitted. The new mold base can be automatically loaded onto the work table by a mold base feed conveyor.

Figure 23:
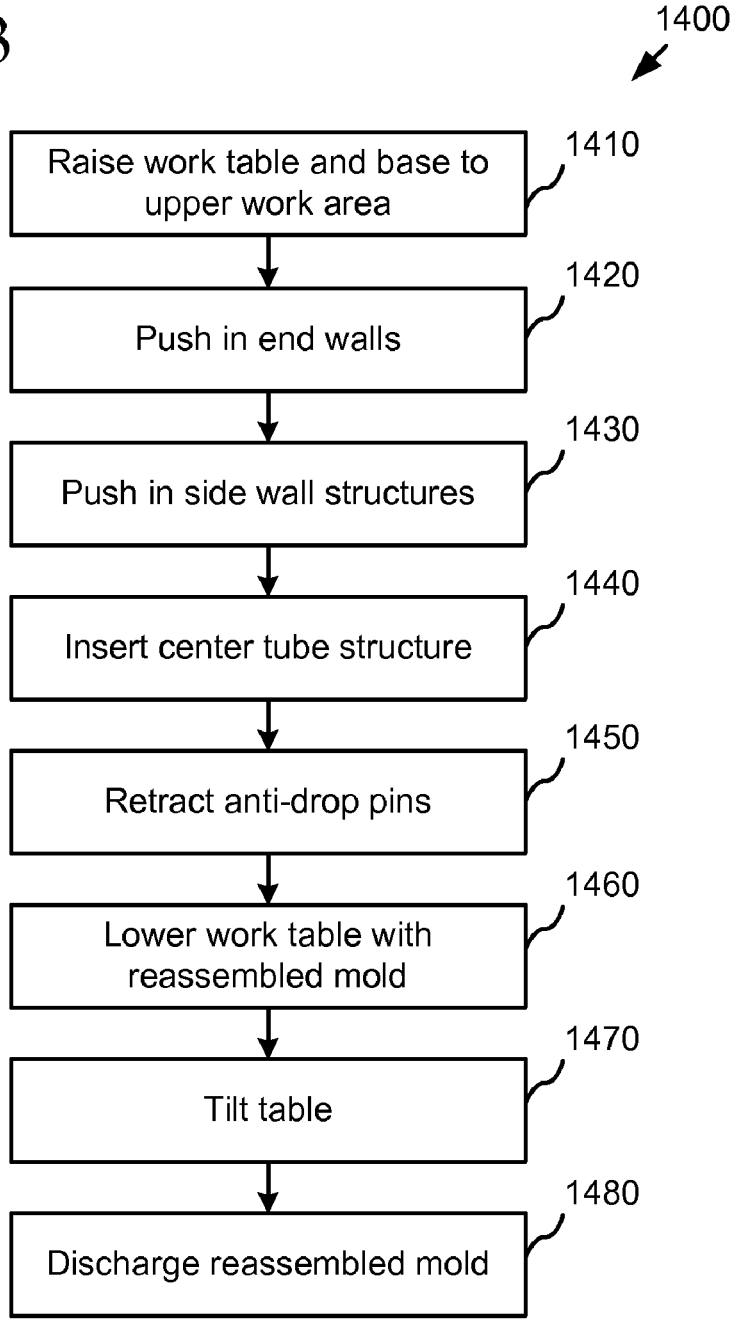
FIG. 23 is a flow chart showing an example technique for reassembling a mold according to one implementation.

FIG. 23 is a flow chart showing a detailed technique 1400 for reassembling a mold according to one implementation. The steps shown in FIG. 23 can be performed by an operator interacting with a control station, by hand, automatically, or some combination of automatic and manual operation. In the example illustrated in FIG. 23, the new (empty) base is raised to the upper work area at 1410, where the disassembled mold is held. In the example shown in FIG. 23, anti-drop pins are already engaged, holding the partially assembled mold frame in place in the upper work area. At 1420, the end walls are pushed in simultaneously, to engage with the base and lid. At 1430, the side wall assemblies (e.g., side walls and side tubes structures) are pushed in simultaneously to engage with the end walls, base, and lid. When end walls and side walls are in place, at 1440 the center tube is inserted. At 1450, the anti-drop pins are retracted, and at 1460, the mold is lowered to the lower work area. At 1470, the work table is tilted toward a discharge table. At 1480, the reassembled mold is transferred to the mold discharge table.

Alternatively, a new mold base is not inserted as part of a mold reassembly process; instead, the used mold base returns to where the mold is cleaned for re-use and is re-added to the mold at that point. In this case, the base feed table 792 is not needed.

Figure 24:
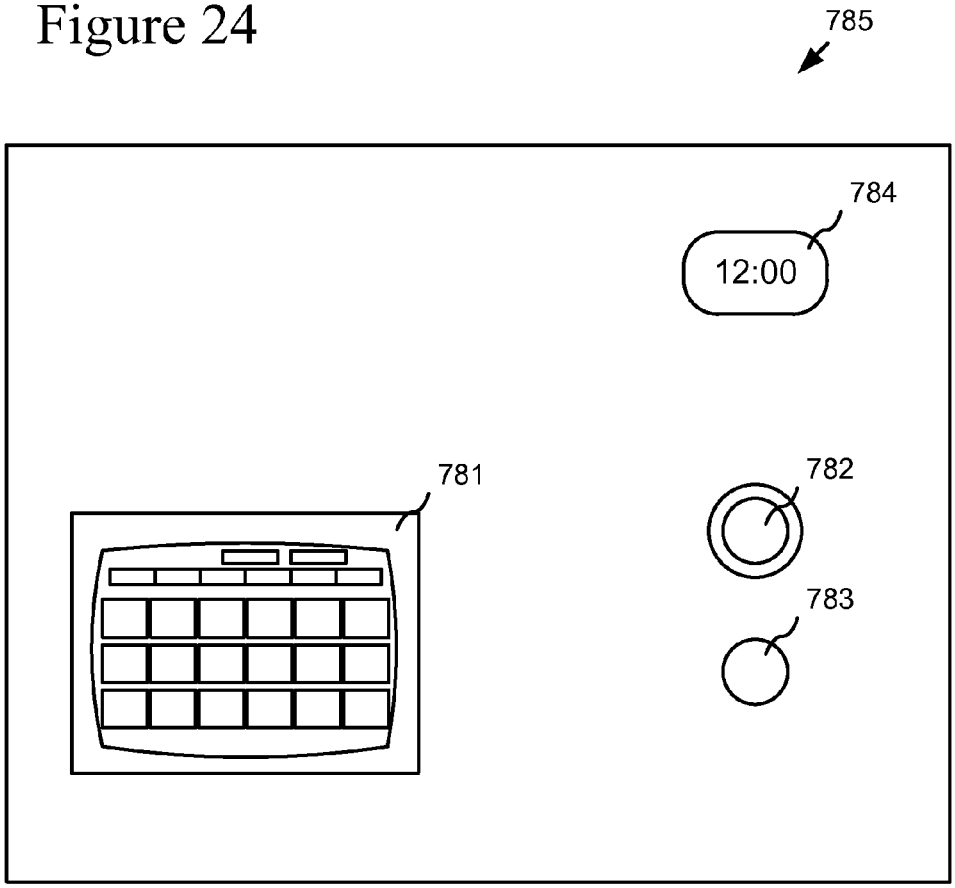
FIG. 24 is a diagram of a control station user interface according to one implementation.

FIG. 24 is a diagram of a control station user interface 785 for the control station 780 according to one implementation. In the example shown in FIG. 24, the control station user interface 785 includes a touch screen 781 upon which are displayed programmed options appropriate to various stages of the block production, mold assembly and mold disassembly processes. Those skilled in the art will appreciate that other types of display devices and input/output devices may be used to enable system monitoring and control from the control station 780. The programmed options available on the touch screen 781 include options to perform steps in either manual or automatic mode. In manual mode, the operator can initiate each step individually via selections made on the touch screen 781 at the control station 780. Also shown in FIG. 24 are an emergency stop button 782, a start button 783 and a time clock 784 (e.g., for monitoring mold disassembly time, mold assembly time, etc.). Other general purpose or special purpose user interface elements also can be used to perform steps of the block production, mold assembly and mold disassembly processes.

The mold assembly/disassembly unit can be used to assemble and disassemble other kinds of molds, such as molds containing solid blocks without voids formed by pipes integrated into the mold. The mold assembly/disassembly unit recognizes (or an operator recognizes) the type of mold in use prior to assembling or disassembling the mold. For example, when a mold having compacting side walls but no center tube or side tubes has been raised into the upper work area, the mold assembly/disassembly unit bypasses the function to extract the center tube and retracts the side walls. Similarly, during mold reassembly, the mold assembly/disassembly unit bypasses the step associated with re-inserting the central pipe.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A method of removing a molded block from a compactable mold, the method comprising:

retracting a first tube structure that extends into the molded block through at least one end wall of the compactable mold, such that the at least one end wall remains substantially stationary during the retracting of the first tube structure and such that the molded block remains substantially stationary and supported by a mold base of the compactable mold during the retracting of the first tube structure;

retracting plural sidewall structure from opposite sides of the compactable mold, the plural sidewall structures each comprising a sidewall and a side tube structure that extends into the molded block through the respective sidewall, and retracting the side tube structures through the respective sidewall before retracting the respective sidewall, wherein each side tube structure is attached to the respective sidewall such that the side tube structure is operable to be moved independently of the respective sidewall without becoming disconnected from the respective sidewall, and the molded block remains substantially stationary and supported by the mold base during the retracting of the plural sidewall structures; and releasing plural end walls of the compactable mold, such that the mold block remains substantially stationary and supported by the mold base during the releasing of the plural end walls.

2. The method of claim 1 further comprising, prior to retracting the first tube structure:

conveying the compactable mold to a mold assembly/disassembly unit;

positioning the compactable mold on a table that is capable of being raised and lowered;

raising the table with the compactable mold to an upper work area.

3. The method of claim 2 further comprising engaging one or more anti-drop pins to secure the mold in the upper work area.

4. The method of claim 2 wherein the positioning comprises locking the mold base to the table.

5. The method of claim 2 wherein the positioning comprises using sensors to position the mold base on the table.

6. The method of claim 2 further comprising:

disconnecting the mold base from the compactable mold;

lowering the table with the mold base and the molded block supported thereon; and removing the mold base and the molded block from the table.

7. The method of claim 6 further comprising disengaging one or more anti-drop pins prior to lowering the table.

8. The method of claim 5 further comprising:

conveying a second mold base to the mold assembly/disassembly unit;

positioning the second mold base on the table;

raising the table with the second mold base to the upper work area; and reassembling the compactable mold such that the reassembled compactable mold comprises the second mold base.

9. The method of claim 1 wherein each side tube structure is attached to the respective side wall by connection hardware comprising a telescoping connector.

10. The method of claim 1 wherein each side tube structure is attached to the respective side wall by connection hardware comprising a spring.

* * * * *